US006945073B2

(12) United States Patent
Matsumoto et al.

(10) Patent No.: US 6,945,073 B2
(45) Date of Patent: Sep. 20, 2005

(54) REFRIGERANT CYCLING DEVICE AND COMPRESSOR USING THE SAME

(75) Inventors: Kenzo Matsumoto, Oizumi-machi (JP); Kazuya Sato, Oizumi-machi (JP); Kentaro Yamaguchi, Oizumi-machi (JP); Kazuaki Fujiwara, Ota (JP); Masaji Yamanaka, Tatebayashi (JP); Haruhisa Yamasaki, Oizumi-machi (JP)

(73) Assignee: Sanyo Electric Co., Ltd., Osaka (JP)

( * ) Notice: Subject to any disclaimer, the term of this patent is extended or adjusted under 35 U.S.C. 154(b) by 80 days.

(21) Appl. No.: 10/649,561

(22) Filed: Aug. 26, 2003

(65) Prior Publication Data

US 2004/0040339 A1 Mar. 4, 2004

(30) Foreign Application Priority Data

| | | |
|---|---|---|
| Aug. 30, 2002 | (JP) | 2002-253225 |
| Sep. 11, 2002 | (JP) | 2002-265365 |
| Sep. 11, 2002 | (JP) | 2002-265542 |
| Sep. 13, 2002 | (JP) | 2002-268321 |
| Sep. 19, 2002 | (JP) | 2002-272986 |
| Sep. 20, 2002 | (JP) | 2002-275172 |
| Sep. 27, 2002 | (JP) | 2002-283956 |

(51) Int. Cl.[7] ..... F25B 43/02; F25B 1/00; F25B 41/00

(52) U.S. Cl. ..... 62/470; 62/513; 62/84; 62/498

(58) Field of Search ..... 62/470, 513, 84, 62/498, 278, 510; 418/63, 60, 248

(56) References Cited

U.S. PATENT DOCUMENTS

| | | | | |
|---|---|---|---|---|
| 5,095,712 A | * | 3/1992 | Narreau | 62/113 |
| 6,189,335 B1 | * | 2/2001 | Ebara et al. | 62/510 |
| 6,581,408 B1 | * | 6/2003 | Tadano et al. | 62/513 |

* cited by examiner

*Primary Examiner*—Chen Wen Jiang
(74) *Attorney, Agent, or Firm*—J.C. Patents

(57) ABSTRACT

A refrigerant cycling device is provided, wherein a compressor comprises an electric motor element, a first and a second rotary compression elements in a sealed container. The first and the second rotary compression elements are driven by the electric motor element. The refrigerant compressed and discharged by the first rotary compression element is compressed by absorbing into the second rotary compression element, and is discharged to the gas cooler. The refrigerant cycling device comprises an intermediate cooling loop for radiating heat of the refrigerant discharged from the first rotary compression element by using the gas cooler; a first internal heat exchanger, for exchanging heat between the refrigerant coming out of the gas cooler from the second rotary compression element and the refrigerant coming out of the evaporator; and a second internal heat exchanger, for exchanging heat between the refrigerant coming out of the gas cooler from the intermediate cooling loop and the refrigerant coming out of the first internal heat exchanger from the evaporator.

5 Claims, 16 Drawing Sheets

REFRIGERANT CYCLING DEVICE AND COMPRESSOR USING THE SAME

CROSS-REFERENCE TO RELATED APPLICATION

This application claims the priority benefit of Japanese applications serial no. 2002-265365, filed on Sep. 11, 2002; Serial no. 2002-275172, filed on Sep. 20, 2002; serial no. 2002-272986, filed on Sep. 19, 2002; serial no. 2002-265542, filed on Sep. 11, 2002; serial no. 2002-268321, filed on Sep. 13, 2002; serial no. 2002-253225, filed on Aug. 30, 2002; serial no. 2002-283956, filed on Sep. 27, 2002.

BACKGROUND OF THE INVENTION

1. Field of the Invention

This invention relates in general to a refrigerant cycling device, for example, a transcritical refrigerant cycling device, wherein a compressor, a gas cooler, a throttling means and an evaporator are connected in sequence, and a hyper critical pressure is generated at a high pressure side. In addition, the present invention relates to a refrigerant cycling device using a multi-stage compression type compressor.

2. Description of Related Art

In a conventional refrigerant cycling device, a rotary compressor (compressor), a gas cooler, a throttling means (such as an expansion valve), are circularly connected with pipes in sequence, so as to construct a refrigerant cycle (a refrigerant cycling loop). The refrigerant gas is absorbed from an absorption port of a rotary compression element of the rotary compressor into a low pressure chamber of a cylinder. By an operation of a roller and a valve, the refrigerant gas is compressed to a high temperature and high pressure refrigerant gas. The high temperature and high pressure refrigerant gas passes through a discharging port, a discharging muffler chamber, and then is discharged to the gas cooler. After the refrigerant gas releases heat at the gas cooler, the refrigerant gas is throttled by the throttling means and then supplied to the evaporator. The refrigerant gas is evaporated by the evaporator. At this time, heat is absorbed from the ambience to achieve a cooling effect.

For addressing earth environment issues, this kind of refrigerant cycling loop also begins to use a nature refrigerant, such as carbon dioxide ($CO_2$), rather than use a conventional Freon refrigerant. A device using a transcritical cycle where the high pressure side is operated as a hyper critical pressure is developed.

In such a transcritical cycling device, liquid refrigerant will return back to the compressor. For preventing a liquid compression, a receiver tank is arranged at a low pressure side between an outlet of the evaporator and an absorption side of the compressor. The liquid refrigerant is thus accumulated at the receiver tank, and only the gas is absorbed into the compressor. Referring to Japanese Laid Open Publication H07-18602, the throttling means is adjusted so that the liquid refrigerant in the receiver tank will not return back to the compressor.

However, a large amount of refrigerant has to be filled for installing the receiver tank at the low pressure side of the refrigerant cycle. In addition, an aperture of the throttling means has to be reduced for preventing a liquid back effect; otherwise, the capacity of the receiver tank has to be increased. That will cause a reduction of the cooling ability and an enlargement of an installation space. For solving the liquid compression in the compressor without using the receiver tank, the present inventors develop a conventional refrigerant cycling device as shown in FIG. 18.

Referring to FIG. 18, an internal intermediate pressure multi-stage (two stages) rotary compressor 10 comprises an electric motor element (a driving element) 14 in a sealed container 12, a first rotary compression element 32 and a second rotary compression element 34 both of which are driven by a rotational shaft 16 of the electric motor element 14.

The operation of the aforementioned refrigerant cycling device is described as follows. The refrigerant absorbed from a refrigerant introduction pipe 94 of the compressor 10 is compressed by the first rotary compression element 32 to possess an intermediate pressure, and then is discharged from the sealed container 12. Afterwards, the refrigerant comes out of the refrigerant introduction pipe 92 and flows into an intermediate cooling loop 150A. The intermediate cooling loop 150A is arranged to pass through a gas cooler 154, so that heat is radiated in an air cooling manner at the intermediate cooling loop 150A and heat of the intermediate pressure is taken by the gas cooler 154.

Thereafter, the refrigerant is absorbed into the second rotary compression element 34 and the second stage compression is performed, so that the refrigerant gas becomes high pressure and high pressure. At this time, the refrigerant is compressed to have a suitable hyper critical pressure.

After the refrigerant gas discharged from a refrigerant discharging pipe 96 flows into the gas cooler 154 and radiated in an air cooling manner, the refrigerant gas passes through an internal heat exchanger 160. Heat of the refrigerant is taken at the internal heat exchanger 160 by the refrigerant coming out of the evaporator 157 and thus is further cooled. Then, the refrigerant is depressurized by an expansion valve 156, and becomes gas/liquid mixed status during that process. Next, the refrigerant flows into the evaporator 157 and evaporates. The refrigerant coming out of the evaporator 157 passes through the internal heat exchanger 160, and takes heat from the refrigerant of the high pressure side so as to be heated.

The refrigerant heated by the internal heat exchanger 160 is then absorbed from the refrigerant introduction pipe 94 into the first rotary compression element 32 of the rotary compressor 10. In the refrigerant cycling loop, the aforementioned cycle is repeated.

In the transcritical refrigerant cycling device as described above in FIG. 18, the refrigerant can possess an overheat degree in a manner that the refrigerant coming out of the evaporator 157 is heated by the refrigerant of the high pressure side by using the internal heat exchanger 160. Therefore, the receiver tank at the low pressure side can be abolished. However, since redundant refrigerant may occur due to a certain operation condition, a liquid back effect in the compressor 10 will arise and a damage caused by the liquid compression might be occur.

In addition, in the aforementioned transcritical refrigerant cycling device, if an evaporation temperature at the evaporator reaches a low temperature range of −30° C. to −40° C. or an extremely low temperature range equal to or less than −50° C., the compression ratio will become very high. Therefore, it is very difficult to achieve the above temperature range because the temperature of the compressor 10 itself becomes very high.

Furthermore, Japanese patent No. 2507047 discloses a refrigerant cycling device using an internal intermediate pressure multi-stage (two stages) rotary compressor. In the refrigerant cycling device, the intermediate pressure refrigerant gas in the sealed container is absorbed from the absorption port of the second rotary compression element to the low pressure chamber of the cylinder. By the operation of the roller and the valve, the second stage compression is performed and thus the refrigerant becomes high temperature and high pressure. From the high pressure chamber and passing through the discharging port and the discharging muffler chamber, the refrigerant is discharged to the exterior of the compressor. Thereafter, the refrigerant enters the gas cooler for radiating heat to achieve a heating effect, and then the refrigerant is throttled by an expansion valve (as the throttling means) to enter the evaporator. After the refrigerant absorbs heat to evaporate at the evaporator, the refrigerant is absorbed into the first rotary compression element. The aforementioned cycle is repeated.

However, in the refrigerant cycling device using the above compressor, if there is a pressure difference of the rotary compression element when restarting after the compressor stops, the start ability will degrade and damage will be caused. In order to equalize the pressure in the refrigerant cycling loop early after the compressor stops, there is a situation that the expansion valve is fully open to connect the low pressure e side and the high pressure side. However, the low pressure side and the high pressure side does not connect to each other after the compressor stops, the intermediate pressure refrigerant gas in the sealed container, which is compressed by the first rotary compression element, needs time to achieve an equilibrium pressure.

In addition, since the heat capacitance of the compressor is large, the temperature reducing speed is very slow. After the compressor stops operating, the temperature in the compressor might be higher than the other portion of the refrigerant cycling loop. Moreover, in a case that the refrigerant immerses into the compressor (the refrigerant is liquidized) after the compressor stops, an intermediate pressure is suddenly increased since the refrigerant becomes a flash gas immediately after the compressor starts. Therefore, the pressure of the intermediate pressure refrigerant gas in the sealed container is conversely higher than a pressure at the discharging side (the high pressure side in the refrigerant cycling loop) of the second rotary compression element; namely, a so-called pressure inversion phenomenon occurs. In this case, the pressure behavior when the compressor starts is described according to FIGS. 19 and 20. FIG. 19 is a conventional diagram of a pressure behavior when the compressor starts normally. Since the pressure in the refrigerant cycling device reaches an equilibrium pressure before the compressor starts, the compressor can start as usually, so that a pressure inversion between the intermediate pressure and the high pressure will not occur.

On the other hand, FIG. 20 shows a pressure behavior when the pressure inversion phenomenon occurs. As shown in FIG. 20, the low pressure and the high pressure are equalized (solid line) before the compressor starts. However, as described above, when the compressor starts, the intermediate pressure becomes higher than the equalized pressure (dash line), and thus, the intermediate pressure increases much more and becomes as high as or higher than the high pressure.

Particularly, in the rotary compressor, since a valve of the second rotary compressor element is energized to a roller side, the pressure at the discharging side of the second rotary compression element acts as a back pressure. However, in that case, since the pressure at the discharging side of the second rotary compression element (the high pressure) is the same as the pressure at the absorption side of the second rotary compression element (the intermediate pressure) or the pressure at the absorption side of the second rotary compression element (the intermediate pressure) is higher, the back pressure that the valve energies to the roller will not act and thus the valve of the second rotary compression element might fly. Therefore, the compression of the second rotary compression element is not performed and in fact, only the compression of the first rotary compression element is performed.

In addition, for the valve of the first rotary compression element, since the valve is energized to the roller, the intermediate pressure in the sealed container acts as a back pressure. However, as the pressure in the sealed container increases, a pressure difference between the pressure in the cylinder of the first rotary compression element and the pressure in the sealed container is too large, and a force that valve presses to the roller has to be increased. Therefore, a surface pressure acts obviously on a sliding portion between the front end of the valve and the outer circumference of the roller, so that the valve and the roller are worn to cause a dangerous damage.

On the other hand, as described above, in the case that the intermediate pressure compressed by the first rotary compression element is cooled by the intermediate heat exchanger, due to a certain operation condition the temperature of the high pressure refrigerant compressed by the second rotary compression element may not satisfy a desired temperature.

Particularly, when the compressor starts, the temperature of the refrigerant is very difficult to increase. In addition, there is also a situation that the refrigerant gas immerses into the compressor (liquidization). In this case, it needs that the temperature inside the compressor can rise early to return the normal operation. However, as described above, in the case that the refrigerant compressed by the first rotary compression element is cooled by the intermediate heat exchanger and absorbed into the second rotary compression element, it is very difficult to rise the temperature in the compressor early.

Furthermore, in the aforementioned compressor, an opening at the upper side of the second rotary compression element is blocked by a supporting member, and another opening at the lower side is blocked by an intermediate partition plate. A roller is disposed in the cylinder of the second rotary compression element. The roller is embedded to an eccentric part of the rotational shaft. For preventing from wearing the roller between the roller and the aforementioned supporting member arranged at the upper side of the roller as well as between the roller and the aforementioned intermediate partition plate arranged at the lower side of the roller, a tiny gap is formed. As a result, the high pressure refrigerant gas compressed by the cylinder of the second rotary compression element might flow from the gap to the inner side of the roller, so that the high pressure refrigerant gas will accumulate at the inner side of the roller.

As mentioned above, as the high pressure refrigerant accumulates at the inner side of the roller, since the pressure at the inner side of the roller becomes higher than the pressure (the intermediate pressure) of the sealed container whose bottom servers as an oil accumulator, it is very difficult to utilize a pressure difference to supply the oil from the oil supplying hole to the inner side of the roller through an oil hole of the rotational shaft, causing an insufficient oil supplying amount to the peripheral of the eccentric part of the inner side of the roller. Conventionally, as shown in FIG. 21, a passage 200 for connecting the inner side (the eccentric part side) of the roller of the second rotary compression element and the sealed container is arranged in the upper supporting member 201 that is arranged at the upper side of the cylinder of the second rotary compression element. Therefore, the high pressure refrigerant gas accumulated at the inner side of the roller will be released into the sealed container, so as to prevent the inner side of the roller from becoming a high pressure.

However, for forming the aforementioned passage 200 that connects the inner side of the roller and the interior of the sealed container, it has to form two passages 200A, 200B, wherein the passage 200A is formed in an axial direction by drilling a hole at the inner side of the roller at the inner circumference of the upper supporting member, and the passage 200B is formed in the horizontal direction for connecting the passage 200A and the sealed container. Therefore, the processing work for forming the passages increases, and thus its corresponding manufacturing cost also increases.

On the other hand, since the pressure (the high pressure) in the cylinder of the second rotary compression element is higher than the pressure (the intermediate pressure) in the sealed container whose bottom servers as the oil accumulator, it is very difficult to utilize a pressure difference to supply the oil from the oil supplying hole or the oil hole of the rotational shaft to the interior of the cylinder of the second rotary compression element. By only using the oil melted into the absorbed refrigerant to lubricate, there might be a problem of insufficient oil supplying amount.

Moreover, in the aforementioned rotary compressor, the refrigerant gas compressed by the second rotary compression element is directly discharged to the exterior. However, the aforementioned oil supplied to a sliding part inside the second rotary compression element is mixed with the refrigerant gas, and then, the oil is discharged to the exterior together with the refrigerant gas. Therefore, the oil in the oil accumulator inside the sealed container becomes insufficient, so that a lubrication ability for the sliding part degrades and the ability of the refrigerant cycling loop degrades because a large amount of oil flows to the refrigerant cycling loop. In addition, for preventing the above problem, if the oil supplying amount to the second rotary compression element is reduced, there will be a problem in a circularity of the sliding part of the second rotary compression element.

SUMMARY OF THE INVENTION

According to the foregoing description, an object of this invention is to provide a transcritical refrigerant cycling device where a high pressure side becomes a hyper critical pressure, so that damages due to a liquid compression in the compressor can be prevented without disposing a receiver tank.

In addition, it is another object of the present invention to provide a transcritical refrigerant cycling device where a high pressure side becomes a hyper critical pressure, so that damages due to a liquid compression in the compressor can be prevented without disposing a receiver tank at the low pressure side, and the cooling ability of the evaporator can be improved.

It is still another object of the present invention to provide a refrigerant cycling device using a so-called multi-stage compression type compressor, wherein an inversion phenomenon of the refrigerant pressure can be avoided, and a start ability and a durability of the compressor can be improved and increased.

It is still another object of the present invention to provide a refrigerant cycling device using a so-called multi-stage compression type compressor, wherein a discharging temperature of the refrigerant that is compressed and discharged by the second rotary compression element can be maintained while preventing the compressor from being overheated.

It is still another object of the present invention to provide a so-called multistage compression type compressor, wherein by using a simple structure, a disadvantage that the inner side of the roller becomes high pressure status can be avoided, and the oil can be smoothly and actually supplied to the cylinder of the second rotary compression element.

It is still another object of the present invention to provide a so-called multi-stage compression type compressor, wherein by using a simple structure, a disadvantage that the inner side of the roller becomes high pressure status can be avoided, and the oil can be smoothly and actually supplied to the cylinder of the second rotary compression element.

It is still another object of the present invention to provide a rotary compressor capable of extremely reducing a amount that the oil flows to the refrigerant cycling loop without decreasing an oil supplying amount to the rotary compression element.

In order to achieve the aforementioned objects, the present invention provides a refrigerant cycling device, in which a compressor, a gas cooler, a throttling means and an evaporator are connected in serial in which a hyper critical pressure is generated at a high pressure side. The compressor comprises an electric motor element, a first and a second rotary compression elements in a sealed container wherein the first and the second rotary compression elements are driven by the electric motor element, and wherein a refrigerant compressed and discharged by the first rotary compression element is compressed by absorbing into the second rotary compression element, and is discharged to the gas cooler. The refrigerant cycling device comprises an intermediate cooling loop for radiating heat of the refrigerant discharged from the first rotary compression element by using the gas cooler; a first internal heat exchanger, for exchanging heat between the refrigerant coming out of the gas cooler from the second rotary compression element and the refrigerant coming out of the evaporator; and a second internal heat exchanger, for exchanging heat between the refrigerant coming out of the gas cooler from the intermediate cooling loop and the refrigerant coming out of the first internal heat exchanger from the evaporator. In this way, the refrigerant coming out of the evaporator exchanges heat at the first internal heat exchanger with the refrigerant coming out of the gas cooler from the second rotary compression element to take heat, and exchanges heat at the second internal heat exchanger with the refrigerant that comes out of the gas cooler and flows in the intermediate cooling loop, so as to take heat. Therefore, a superheat degree of the refrigerant can be actually maintained and a liquid compression in the compression can be avoided.

In addition, since the refrigerant coming out of the gas cooler from the second rotary compression element takes heat at the first internal heat exchanger from the refrigerant coming out the evaporator, the refrigerant temperature can be reduced. Moreover, because of the intermediate cooling loop, the temperature inside the compressor can be reduced. Particularly in that situation, after heat of the refrigerant flowing through the intermediate cooling loop is radiated by the gas cooler, heat is then provided to the refrigerant coming from the evaporator, and the refrigerant is then absorbed into the second rotary compression element.

Therefore, a temperature rising inside the compressor, caused by arranging the second internal heat exchanger, will not occur.

Additionally, in the above refrigerant cycling device, since the refrigerant uses carbon dioxide, it can provide a contribution to solve the environment problem.

Furthermore, the aforementioned refrigerant cycling device is very effective for a condition that an evaporation temperature of the refrigerant at the evaporator is from +12° C. to −10° C.

The present invention further provides a refrigerant cycling device, in which a compressor, a gas cooler, a throttling means and an evaporator are connected in serial in which a hyper critical pressure is generated at a high pressure side. The compressor comprises an electric motor element, a first and a second rotary compression elements in a sealed container wherein the first and the second rotary compression elements are driven by the electric motor element, and wherein a refrigerant compressed and discharged by the first rotary compression element is compressed by absorbing into the second rotary compression element, and is discharged to the gas cooler. The refrigerant cycling device comprises an intermediate cooling loop for radiating heat of the refrigerant discharged from the first rotary compression element by using the gas cooler; an oil separating means for separating oil from the refrigerant compressed by the second rotary compression element; an oil return loop for depressurizing the oil separated by the oil separating means and then returning the oil back to the compressor; a first internal heat exchanger, for exchanging heat between the refrigerant coming out of the gas cooler from the second rotary compression element and the refrigerant coming out of the evaporator; a second internal heat exchanger for exchanging heat between the oil flowing in the oil return loop and the refrigerant coming out of the first internal heat exchanger form the evaporator; and an injection loop, for injecting a portion of the refrigerant flowing between the first and the second throttling means into an absorption side of the second rotary compression element of the compressor. In this manner, the refrigerant coming out of the evaporator exchanges heat at the first internal heat exchanger with the refrigerant coming out of the gas cooler from the second rotary compression element to take heat, and exchanges heat at the second internal heat exchanger with the oil that flows in the oil return loop, so as to take heat. Therefore, a superheat degree of the refrigerant can be actually maintained and a liquid compression in the compression can be avoided.

In addition, since the refrigerant coming out of the gas cooler from the second rotary compression element takes heat at the first internal heat exchanger from the refrigerant coming out the evaporator, the refrigerant temperature can be reduced. Moreover, because of the intermediate cooling loop, the temperature inside the compressor can be reduced.

In addition, after the oil flowing in the oil return loop takes heat from the refrigerant coming out of the first internal heat exchanger from the evaporator at the second internal heat exchanger, the oil returns back to the compressor. Therefore, the temperature in the compressor can be further reduced.

Furthermore, a portion of the refrigerant flowing between the first and the second throttling means passes through the injection loop, and then is injected to the absorption side of the second rotary compression element of the compressor. Therefore, the second rotary compression element can be cooled by the injected refrigerant. In this way, the compression efficiency of the second rotary compression element can be improved, and additionally, the temperature of the compressor itself can be further reduced. Accordingly, the evaporation temperature of the refrigerant at the evaporator of the refrigerant cycling device can be also reduced.

In the above refrigerant cycling device, it further comprises a gas-liquid separating means disposed between the first throttling means and the second throttling means. The injection loop depressurizes a liquid refrigerant separated by the gas-liquid separating means, and then injects the liquid refrigerant into the absorption side of the second rotary compression element of the compressor. In this manner, the evaporation temperature of the refrigerant at the evaporator of the refrigerant cycling device can be also reduced.

In the above refrigerant cycling device, after the oil separated by the oil separating means exchanges heat at the second internal heat exchanger with the refrigerant coming out of the first internal heat exchanger from the evaporator, the oil return loop returns the oil back to the sealed container of the compressor. Therefore, the temperature in the compressor can be effectively reduced by the oil.

In addition, after the oil separated by the oil separating means exchanges heat at the second internal heat exchanger with the refrigerant coming out of the first internal heat exchanger from the evaporator, the oil return loop returns the oil back to the absorption side of the second rotary compression element of the compressor. Therefore, while lubricating the second rotary compression element, the compression efficiency is improved and the temperature of the compressor itself is effectively reduced.

Moreover, in the above refrigerant cycling device, since the refrigerant can use a refrigerant selected from any one of carbon dioxide, R23 of HFC refrigerant and nitrous suboxide, a desired cooling ability can be obtained and a contribution to solve the environment problem can be provided.

Furthermore, the aforementioned refrigerant cycling device is very effective for a condition that an evaporation temperature of the refrigerant at the evaporator is equal to or less than −50° C.

The present invention further provides a refrigerant cycling device, in which a compressor, a gas cooler, a throttling means and an evaporator are connected in serial in which a hyper critical pressure is generated at a high pressure side. The compressor comprises an electric motor element, a first and a second rotary compression elements in a sealed container wherein the first and the second rotary compression elements are driven by the electric motor element, and wherein a refrigerant compressed and discharged by the first rotary compression element is compressed by absorbing into the second rotary compression element, and is discharged to the gas cooler. The refrigerant cycling device comprises an intermediate cooling loop for radiating heat of the refrigerant discharged from the first rotary compression element by using the gas cooler; a first internal heat exchanger, for exchanging heat between the refrigerant coming out of the gas cooler from the second rotary compression element and the refrigerant coming out of the evaporator; an oil separating means for separating oil from the refrigerant compressed by the second rotary compression element; an oil return loop, for depressurizing the oil separated by the oil separating means and then returning the oil back to the compressor; and a second internal heat exchanger, for exchanging heat between the oil flowing in the oil return loop and the refrigerant coming out of the first internal heat exchanger form the evaporator. In this way, In this manner, the refrigerant coming out of the evaporator exchanges heat at the first internal heat exchanger with the refrigerant coming out of the gas cooler from the second rotary compression element to take heat, and exchanges heat at the second internal heat exchanger with the oil that flows in the oil return loop, so as to take heat. Therefore, a superheat degree of the refrigerant can be actually maintained and a liquid compression in the compression can be avoided.

In addition, since the refrigerant coming out of the gas cooler from the second rotary compression element takes heat at the first internal heat exchanger from the refrigerant coming out the evaporator, the refrigerant temperature can be reduced. Moreover, because of the intermediate cooling loop, the temperature inside the compressor can be reduced.

Furthermore, after the oil flowing in the oil return loop takes heat from the refrigerant coming out of the first internal heat exchanger from the evaporator at the second internal heat exchanger, the oil returns back to the compressor. Therefore, the temperature in the compressor can be further reduced, so that the evaporation temperature of the refrigerant at the evaporator of the refrigerant cycling device can be also reduced.

In the above refrigerant cycling device, after the oil separated by the oil separating means exchanges heat at the second internal heat exchanger with the refrigerant coming out of the first internal heat exchanger from the evaporator, the oil return loop returns the oil back to the sealed container of the compressor. Therefore, the temperature in the compressor can be effectively reduced by the oil.

In the above refrigerant cycling device, after the oil separated by the oil separating means exchanges heat at the second internal heat exchanger with the refrigerant coming out of the first internal heat exchanger from the evaporator, the oil return loop returns the oil back to the absorption side of the second rotary compression element of the compressor. Therefore, while lubricating the second rotary compression element, the compression efficiency is improved and the temperature of the compressor itself is effectively reduced.

Additionally, in the above refrigerant cycling device, since the refrigerant uses carbon dioxide, it can provide a contribution to solve the environment problem.

Furthermore, the aforementioned refrigerant cycling device is very effective for a condition that an evaporation temperature of the refrigerant at the evaporator is from −30° C. to −10° C.

The present invention further provides a refrigerant cycling device, in which a compressor, a gas cooler, a throttling means and an evaporator are connected in serial in which a hyper critical pressure is generated at a high pressure side. The compressor comprises an electric motor element, a first and a second rotary compression elements in a sealed container wherein the first and the second rotary compression elements are driven by the electric motor element, and wherein a refrigerant compressed and discharged by the first rotary compression element is compressed by absorbing into the second rotary compression element, and is discharged to the gas cooler. The refrigerant cycling device comprises a bypass loop, for supplying the refrigerant discharged from the first compression element to the evaporator without depressurizing the refrigerant; and a valve means for opening the bypass loop when the evaporator is defrosting, wherein the valve means also opens the bypass loop when the compressor starts. When the evaporator is in defrosting, the valve device is open. Therefore, the discharged refrigerant flows from the first compression element to the bypass loop, and then is provided to the evaporator for heating without depressurizing the refrigerant.

In addition, when the compressor starts, the valve device is also open. By passing the bypass loop, since the pressure at the discharging side of the first compression element (i.e., the absorption side of the second compression element) can be released to the evaporator, an pressure inversion phenomenon between the absorption side of the second compression element (the intermediate pressure) and the discharging side of the second compression element (the high pressure) when the compressor starts can be avoided.

In the above refrigerant cycling device, the bypass loop can be open for a predetermined time from a time point before the compressor starts.

In the above refrigerant cycling device, the bypass loop can be open for a predetermined time from a time point when the compressor starts.

In the above refrigerant cycling device, the bypass loop can be open for a predetermined time from a time point after the compressor starts.

The present invention further provides a refrigerant cycling device, wherein a compressor, a gas cooler, a throttling means and an evaporator are connected in serial, and the compressor comprises a first and a second rotary compression elements, and wherein a refrigerant compressed and discharged by the first rotary compression element is compressed by being absorbed into the second rotary compression element and then is discharged to the gas cooler. The refrigerant cycling device comprises a refrigerant pipe for absorbing the refrigerant compressed by the first rotary compression element into the second rotary compression element; an intermediate cooling loop is connected to the refrigerant pipe in parallel; and a valve device for controlling the refrigerant discharged by the first rotary compression element to flow to the refrigerant pipe or to the intermediate cooling loop. In this way, whether the refrigerant flows to the intermediate cooling loop can be selected according to the refrigerant status.

Therefore, the detection of the refrigerant status is carried out by the pressure or temperature, etc. In other words, when the pressure of the discharged refrigerant or the refrigerant temperature of the second rotary compression element increases up to a predetermined value, the valve device makes the refrigerant to flow to the intermediate cooling loop. Alternatively, when below the predetermined value, the refrigerant flows to the refrigerant pipe.

The above refrigerant cycling device further comprises a temperature detecting means arranged at a position capable of detecting a temperature of the refrigerant discharged from the second rotary compression element. When the temperature of the refrigerant discharged from the second rotary compression element, which is detected by the temperature detecting means, increases up to a predetermined value, the valve device makes the refrigerant to flow to the intermediate cooling loop. Alternatively, when below the predetermined value, the refrigerant flows to the refrigerant pipe.

The present invention further also provides a compressor, having a first and a second rotary compression element driven by a rotational shaft of a driving electric motor element in a sealed container. The compressor comprises cylinders for respectively constructing the first and the second rotary compression elements; rollers respectively formed in the cylinders, wherein each of the rollers is embedded to an eccentric part of the rotational shaft to rotate eccentrically; an intermediate partition plate interposing among the rollers and the cylinders to partition the first and the second rotary compression elements; a supporting member for blocking respective openings of the cylinders and having a bearing of the rotational shaft; and an oil hole formed in the rotational shaft, wherein a penetration hole for connecting the sealed container and an inner side of the rollers is formed in the intermediate partition plate, and a connection hole for connecting the penetration hole of the intermediate partition hole and an absorption side of the second rotary compression element is pierced in the cylinders that constructs the second rotary compression element. Therefore, by using the intermediate partition plate, the high pressure refrigerant accumulated at the inner side of the roller can be released to the inside of the sealed container.

In addition, even though the pressure in the cylinder of the second rotary compression element is higher than the pressure in the sealed container (the intermediate pressure), by using an absorption pressure loss in the absorption process of the second rotary compression element, the oil can be actually supplied to the absorption side of the second rotary compression element from the oil hole of the rotational shaft through the penetration hole and the connection hole of the intermediate partition plate. In this way, since the penetration hole of the intermediate partition plate can be applied to release the high pressure at the inner side of the roller and to supply oil to the second rotary compression element, a simple structure and a cost reduction can be achieved.

In the above compressor, the driving element can be a motor of a rotational number controllable type, which is started with a low speed. Therefore, when the compressor starts, even though the second rotary compression element absorbs the oil in the sealed container from the penetration hole of the intermediate partition plate connecting to the sealed container, an adverse influence due to the oil compression can be suppressed. Accordingly, a reduction of the reliability of the compressor can be reduced.

The present invention further provides a compressor, having an electric motor element and a rotary compression element driven by the electric motor element in a sealed container, wherein a refrigerant compressed by the rotary compression element is discharged to exterior. The compressor comprises an oil accumulator for separating oil discharged from the rotary compression together with the refrigerant and then for accumulating the oil is formed in the rotary compression element; and a return passage having a throttling function, wherein the oil accumulator is connected to the sealed container through the return passage. Therefore, an oil amount discharged from the rotary compression element to the exterior of the compressor can be reduced.

The present invention further provides a compressor, having an electric motor element and a rotary compression mechanism driven by the electric motor element in a sealed container. The rotary compression mechanism is constructed by a first and a second rotary compression elements, wherein a refrigerant compressed by the first rotary compression element is discharged to the sealed container and the discharged refrigerant with an intermediate pressure is compressed by the second rotary compression element, and then discharged to the exterior. The compressor comprises an oil accumulator for separating oil discharged from the second rotary compression together with the refrigerant and then for accumulating the oil is formed in the rotary compression mechanism; and a return passage having a throttling function, wherein the oil accumulator is connected to the sealed container through the return passage. Accordingly, an oil amount discharged from the second rotary compression element to the exterior of the compressor can be reduced.

In the above compressor, it further comprises a second cylinder constructing the second rotary compression element; a first cylinder arranged under the second cylinder through a intermediate partition plate and constructing the first rotary compression element; a first supporting member for blocking a lower part of the first cylinder; a second supporting member for blocking an upper part of the second cylinder; and an absorption passage formed in the first rotary compression element. The oil accumulator is formed in the first cylinder other than a portion where the absorption passage is formed. Therefore, the space efficiency can be improved and increased.

In the previous structure, the oil accumulator is formed by a penetration hole that vertically penetrates through the second cylinder, the intermediate partition plate and the first cylinder. Therefore, the processing workability for forming the oil accumulator can be obviously improved.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
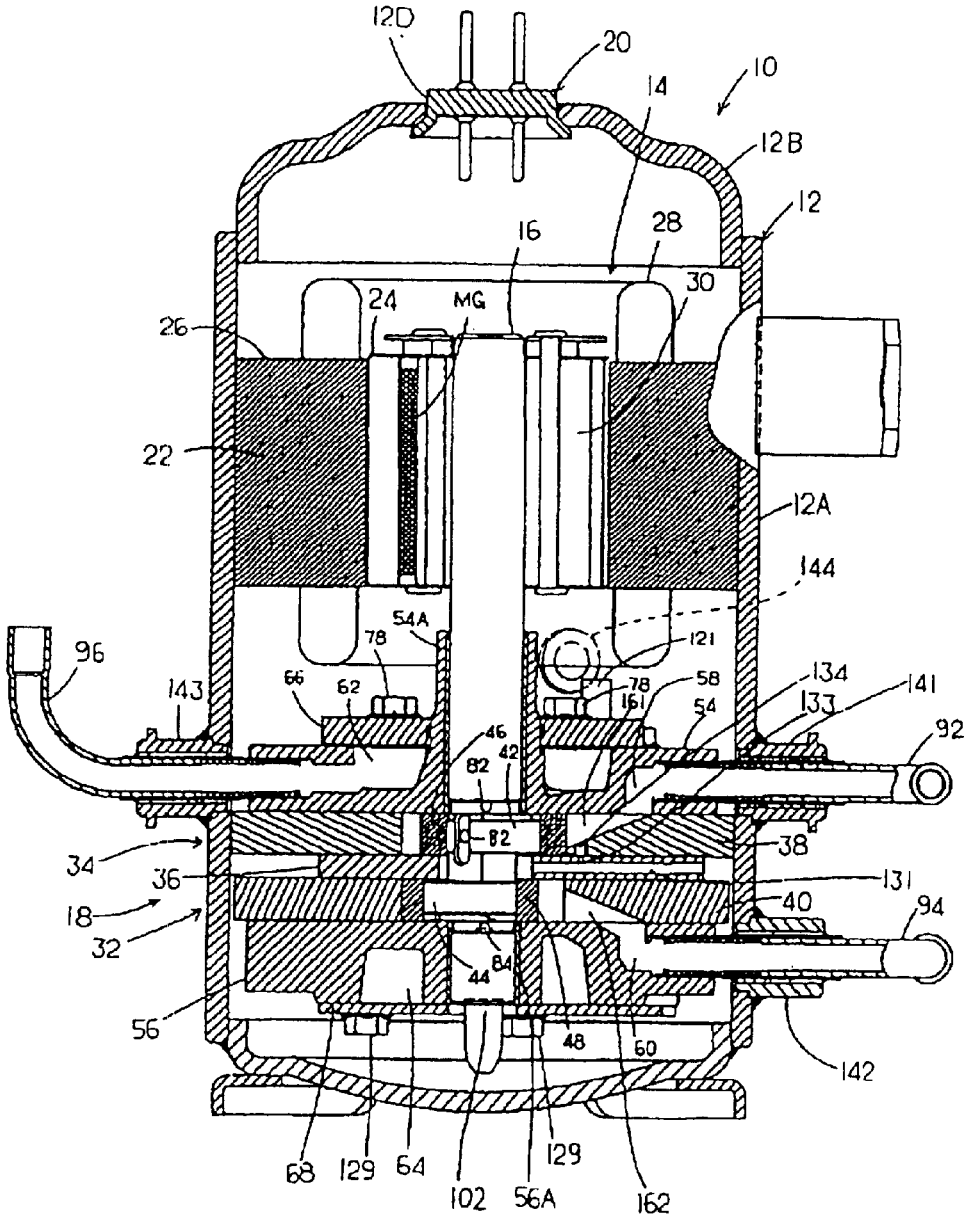
FIG. 1 is a vertical cross-sectional view of an internal intermediate pressure type two-stage compression rotary compressor having a first and a second rotary compression elements 32, 34, which is used as an exemplary compressor used in a transcritical refrigerant cycling device of the present invention.
Figure 2:
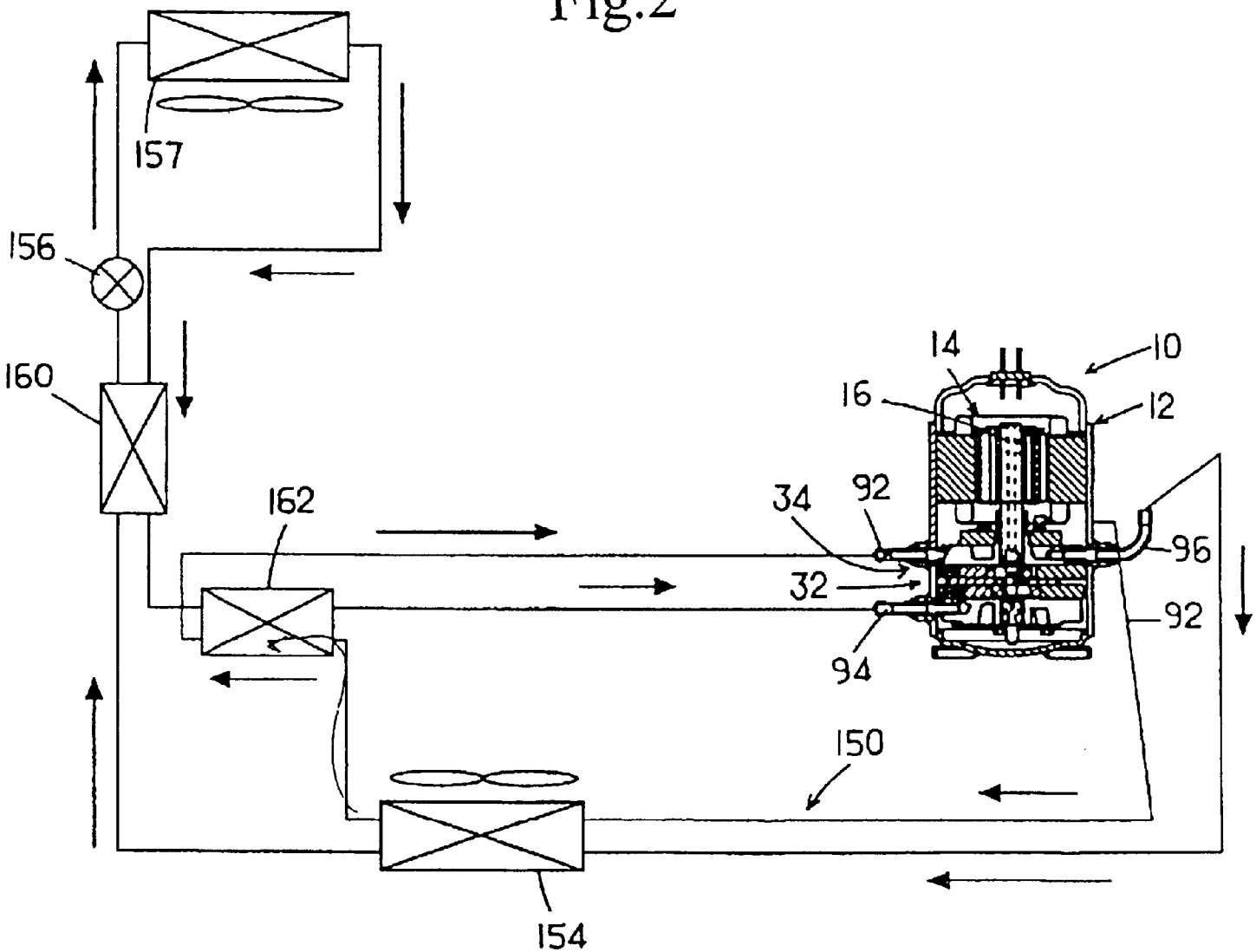
FIG. 2 is a refrigerant cycling loop according to a transcritical refrigerant cycling device of the present invention.

Embodiments of the present invention are described in detail in accordance with attached drawings. FIG. 1 is a vertical cross-sectional view of an internal intermediate pressure type multi-stage (e.g., two stages) compression rotary compressor 10 having a first and a second rotary compression elements 32, 34, as an exemplary compressor used in a cycling device, particularly a transcritical refrigerant cycling device of the present invention. FIG. 2 is a refrigerant loop diagram of a transcritical refrigerant cycling device of the present invention. The transcritical refrigerant cycling device can be used, for example, in a vending machine, an air-conditioner, a freezer, or a showcase, etc.

In the drawings, the internal intermediate pressure type multi-stage compression rotary compressor (rotary compressor, hereinafter) 10 uses carbon dioxide ($CO_2$) as the refrigerant. The rotary compressor 10 is constructed by a rotary compression mechanism 18, which comprises a sealed container 12, a first rotary compression element (the first stage) 32, and a second rotary compression element 34 (the second stage). The first rotary compression element 32 is driven by an electrical motor element 14 and a rotary shaft 16 of the electrical motor element 14, in which the electrical motor element 14 is received at an upper part of an internal space of the sealed container 12 and the rotary shaft 16 is arranged under the electrical motor element 14. As an example of the embodiment, the capacity of the first rotary compression element 32 of the rotary compressor 10 is 2.89 c.c., and the capacity of the second rotary compression element 32 (as the second stage) is 1.88 c.c.

In the sealed container 12, the bottom part is constructed by a container main body 12A and an end cap 12B. The container main body 12A is used to contain the electrical motor element 14 and the rotary compression mechanism 18, and serves as an oil accumulator. The end cap 12B is substantially a bowl shape for blocking an upper opening of the container main body 12A. A circular installation hole 12D is further formed in the center of the upper surface of the end cap 12B, and a terminal (wirings are omitted) 20 are installed into the installation hole 12D for providing power to the electrical motor element 14.

The electrical motor element 14 is a DC (direct current) motor of a so-called magnetic-pole concentrated winding type, and comprises a stator 22 and a rotor 24. The stator 22 is annularly installed along an inner circumference of an upper space of the sealed container 12, and the rotor 24 is inserted into the stator 22 with a slight gap3. The rotor 24 is affixed onto the rotational shaft 16 that passes the center and extends vertically.

The stator 22 comprises a laminate 26 formed by doughnut-shaped electromagnetic steel plates and a stator coil 28 that is wound onto tooth parts of the laminate 26 in a series (concentrated) winding manner. Additionally, similar to the stator 22, the rotor 24 is also formed by a laminate 30 of electromagnetic steel plates, and a permanent magnet MG is inserted into the laminate 30.

An oil pump 102, serving as an oil supply means, is formed at a lower end of the rotational shaft 16. By using the oil pump 102, lubricant oil is sucked from the oil accumulator that is formed at the bottom in the sealed container 12. The lubricant oil passes through an oil hole (not shown), which is vertically formed at an axial center of the rotational shaft 16. From lateral oil supplying holes 82, 84 (also formed in an upper and a lower eccentric parts 42, 44) connected to the oil hole, the lubricant oil is supplied to sliding parts of the upper and the lower eccentric parts 42, 44, as well as the first and the second rotary compression elements 32, 34. In this manner, the first and the second rotary compression elements 32, 34 can be prevented from wear, and can be sealed.

An intermediate partition plate 36 is sandwiched between the first rotary compression element 32 and the second rotary compression element 34. Namely, the first rotary compression element 32 and the second rotary compression element 34 are constructed by the intermediate partition plate 36, an upper and a lower cylinders 38, 40, an upper and a lower roller 46, 48, valves 50, 52, and an upper and a lower supporting members 54, 56. The upper and the lower cylinders 38, 40 are respectively arranged above and under the intermediate partition plate 36. The upper and the lower roller 46, 48 are eccentrically rotated by an upper and a lower eccentric parts 42, 44 that are set on the rotational shaft 16 with a phase difference of 180° in the upper and the lower cylinders 38, 40. The valves 50, 52 are in contact with the upper and the lower roller 46, 48 to divide the upper and the lower cylinders 38, 40 respectively into a low pressure chamber and a high pressure chamber. The upper and the lower supporting members 54, 56 are used to block an open surface at the upper side of the upper cylinder 38 and an open surface at the lower side of the lower cylinder 40, and are also used as a bearing of the rotational shaft 16.

In addition, absorption passages 58, 60 for connecting the upper and the lower cylinders 38, 40 respectively by absorbing ports 161, 162, and recess discharging muffler chambers 62, 64 are formed in the upper and the lower supporting members 54, 56. In addition, openings of the two discharging muffler chamber 62, 64, which are respectively opposite to the cylinder 38, 40 are blocked by covers. Namely, the discharging muffler chamber 62 is covered by an upper cover 66, and the discharging muffler chamber 64 is covered by a lower cover 68.

In the foregoing condition, a bearing 54A is formed by standing on the center of the upper supporting member 54, and a bearing 56A is formed by penetrating the center of the lower supporting member 56. As a result, the rotational shaft 16 is held by the bearing 54A formed on the upper supporting member 54 and the bearing 56A formed on the lower supporting member 56.

The lower cover 68 is formed by a circular steel plate (e.g., a doughnut shape), and is fixed onto the lower supporting member 56 by screwing main bolts 129 from bottom to four locations at the circumference. The tips of the main bolts 129 are screwed to engage with the upper supporting member 54.

The discharging muffler chamber 64 of the first rotary compression element 32 and the inner space of the sealed contained 12 are connected by a connection passage. This connection passage is a hole (not shown) that penetrates the lower supporting member 56, the upper supporting member 54, the upper cover 66, the upper and the lower cylinders 38, 40 and the intermediate partition plate 36. In this case, an intermediate discharging pipe 121 is formed by standing on the top end of the connection passage. The refrigerant with an intermediate pressure is discharged from the intermediate discharging pipe 121 to the sealed container 12.

In addition, the upper cover 66 divides to form the interior of the upper cylinder 38 of the second rotary compression element 34 and the discharging muffler chamber 62 that connects to the discharging port. The electric motor element 14 is arranged on the upper side of the upper cover 66 with a predetermined gap from the upper cover 66. The upper cover 66 is formed by a circular steel plate with a substantially doughnut shape and has a hole formed thereon, wherein a bearing 54A of the upper supporting member 54 penetrates through that hole. By four main bolts 78, the peripheral of the upper cover 66 is fixed onto the top of the upper supporting member 54. The front ends of the main bolts 78 are screwed to the lower supporting member 56.

Considering that the refrigerant is good for the earth environment, the combustibility and the toxicity, the refrigerant uses a nature refrigerant, i.e., the aforementioned carbon dioxide ($CO_2$). The oil, used as a lubricant oil sealed in the sealed container 12, can use existed oil, for example, a mineral oil, an alkyl benzene oil, an ether oil, and a PAG (poly alkyl glycol).

In addition, the sleeves 141, 142, 143 and 144 are fused to fix on the side faces of the main body 12A of the sealed container 12 at positions corresponding to the absorption passages 58, 60 of the upper supporting member 54 and the lower supporting member 56 and the upper sides of the discharging muffler chamber 62 and the upper cover 66 (positions substantially corresponding to the lower end of the electric motor element 14). One end of the refrigerant introduction pipe 92 for introducing the refrigerant gas to the upper cylinder 38 is inserted into the sleeve 141, and that end of the refrigerant introduction pipe 92 is connected to the absorption passage 58 of the upper cylinder 38. The refrigerant introduction pipe 92 passes through the second internal heat exchanger 162 arranged in the intermediate cooling loop, the gas cooler, and then reaches the sleeve 144. Alternatively, the refrigerant introduction pipe 92 passes through the intermediate cooling loop where the gas cooler passes through, and then reaches the sleeve 144. The other end is inserted into the sleeve 144 to connect to the sealed container 12.

The second internal heat exchanger is used to exchange heat between the intermediate pressure refrigerant flowing through the intermediate cooling loop 150 coming out of the gas cooler 154 and the low pressure refrigerant coming out of the first internal heat exchanger 160 from the evaporator 157. Alternatively, the second internal heat exchanger is used to exchange heat between the oil flowing through the oil return loop 175 and the low pressure refrigerant coming out of the first internal heat exchanger 160 from the evaporator 157.

In addition, one end of the refrigerant introduction pipe 94 for introducing the refrigerant gas into the lower cylinder 40 is inserted to connect to the sleeve 142, and that end of the refrigerant introduction pipe 94 is connect to the absorption passage 60 of the lower cylinder 40. The other end of the refrigerant introduction pipe 94 is connected to the second internal heat exchanger 162. In addition, the refrigerant discharging pipe 96 is inserted to connect to the sleeve 143. One end of the refrigerant discharging pipe 96 is connected to the discharging muffler chamber 62.

[Second Embodiment]

In FIG. 2, the aforementioned compressor 10 forms a part of the refrigerant cycle shown in FIG. 2. Namely, the refrigerant discharging pipe 96 of the compressor 10 is connected to an inlet of a gas cooler 154. A pipe, coming out of the gas cooler 154, passes through the aforementioned first internal heat exchanger 160. The first heat exchanger 160 is used for performing a thermal exchange between the refrigerant from the gas cooler 154 at the high pressure side and the refrigerant from an evaporator 157 at the low pressure side.

The refrigerant passing the first internal heat exchanger 160 then reaches an expansion valve 156, serving as a throttling means. The outlet of the expansion valve 156 is connected to the inlet of the evaporator 157. The pipe coming out of the evaporator 157 passes through the first internal heat exchanger 160 and reaches the second internal heat exchanger 162. The pipe coming out of the second internal heat exchanger 162 is connected to a refrigerant introduction pipe 94.

Figure 3:
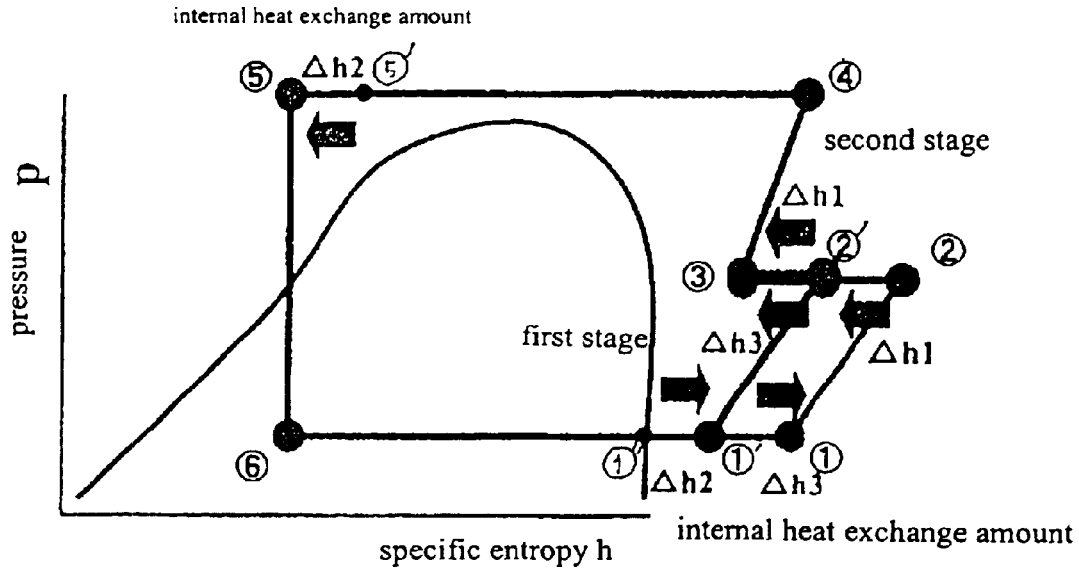
FIG. 3 is a p-h diagram for the refrigerant cycling loop in FIG. 2.

By referring to a p-h diagram (Mollier diagram) in FIG. 3, the operation of the aforementioned structure according to the transcritical refrigerant cycling device of the present invention is described. As the stator coil 28 of the electrical motor element 14 is electrified through the wires (not shown) and the terminal 20, the electrical motor element 14 starts so as to rotate the rotor 24. By this rotation, the upper and the lower roller 46, 48, which are embedded to the upper and the lower eccentric parts 42, 44 that are integrally disposed with the rotational shaft 16, rotate eccentrically within the upper and the lower cylinders 38, 40.

In this way, the low pressure refrigerant gas (status ① in FIG. 3), which passes through the absorption passage 60 formed in the refrigerant introduction pipe 94 and the lower supporting member 56 and is absorbed from the absorption port into the low pressure chamber of the lower cylinder 40, is compressed due to the operation of the roller 48 and the valve 52, and then becomes intermediate pressure status. Thereafter, starting from the high-pressure chamber of the lower cylinder 40, the intermediate pressure refrigerant gas passes through a connection passage (not shown), and then discharges from the intermediate discharging pipe 121 into the sealed container 12. Accordingly, the interior of the sealed container 12 becomes the intermediate pressure status (status ② in FIG. 3).

The intermediate pressure refrigerant gas inside the sealed container 12 enters the refrigerant inlet pipe 92, releases from the sleeve 144, and then flows into the intermediate cooling loop 150. In the process where the intermediate cooling loop 150 passes through the gas cooler 154, heat is radiated in an air cooling manner (status ②' in FIG. 3). Afterwards, the refrigerant passes through the second internal heat exchanger 162 at which heat of the refrigerant is taken away, and is further cooled (status ②' in FIG. 3).

The status is described according to FIG. 3. Heat of the refrigerant flowing through the intermediate cooling loop 150 is radiated at the gas cooler 154. At this time, entropy Δh1 loses. In addition, heat of the refrigerant at the low pressure side is taken away at the second internal heat exchanger 162, so that the refrigerant is cooled, wherein entropy Δh3 loses. As described, by making the intermediate pressure refrigerant gas, which is compressed by the first rotary compression element 32, to pass through the intermediate cooling loop 150, the gas cooler 154 and the second internal heat exchanger 162 can cool the refrigerant effectively. Therefore, a temperature rising within the sealed container 12 can be suppressed, and additionally, the compression efficiency of the second rotary compression element 34 can be increased.

The cooled intermediate pressure refrigerant gas passes through an absorption passage formed in the upper supporting member 54, and then is absorbed from the absorption port into the low pressure chamber of the upper cylinder 38 of the second rotary compression element 34. By the operation of the roller 46 and the valve 50, the two-stage compression is performed, so that the refrigerant gas becomes high pressure and high temperature. Then, the high pressure and high temperature refrigerant goes to the discharging port from the high pressure chamber, passes through the discharging muffler chamber 62 formed in the upper supporting member 55, and then discharges from the refrigerant discharging pipe 96 to the external. At this time, the refrigerant gas is properly compressed to a hyper critical pressure (status ④ in FIG. 3).

The refrigerant gas discharging from the refrigerant discharging pipe 96 flows into the gas cooler 154 at which heat is radiated in an air-cooling manner (status ⑤' in FIG. 3). Afterwards, the refrigerant gas passes through the first internal heat exchanger 160, at which heat of the refrigerant is taken away, and is further cooled (status ⑤ in FIG. 3).

FIG. 3 is used to describe the situation. Namely, when the first internal heat exchanger 160 doest not exist, the entropy of the refrigerant at the inlet of the expansion valve 156 becomes a status represented by status ⑤'. In this situation, the temperature of the refrigerant gas at the evaporator 157 gets high. In addition, when a thermal exchange is performed with the refrigerant at the low pressure side at the first internal heat exchanger 160, the entropy of the refrigerant gas is decreased by Δ2 only and the refrigerant becomes the status represented by ⑤ in FIG. 3. Due to the entropy of the status ⑤' in FIG. 3, the refrigerant temperature at the evaporator 157 is decreased. Therefore, in the case that the first internal heat exchanger 160 is disposed, the cooling ability for the refrigerant gas at the evaporator 157 is increased.

Therefore, without increasing a refrigerant cycling amount, the evaporation temperature at the evaporator 157, for example, can reach a middle-high temperature range between +12° C. and −10° C. easily. In addition, the power consumption of the compressor 10 can be reduced.

The refrigerant gas at the high pressure side, which is cooled by the first internal heat exchanger 160, reaches the expansion valve 156. In addition, the refrigerant gas at the inlet of the expansion valve 156 is still a gas status. Due to a pressure reduction at the expansion valve 156, the refrigerant becomes a two-phase mixture of gas and liquid (status ⑥ in FIG. 3), and with this mixture status, the refrigerant enters the evaporator 157 where the refrigerant evaporates so as to activate a cooling effect by absorbing heat from the air.

The refrigerant then flows out of the evaporator 157 (status ①" in FIG. 3), and passes through the first internal heat exchanger 160. The heat is taken away from the refrigerant at the high pressure side at the first internal heat exchanger 160. After being heated, the refrigerant reaches the second internal heat exchanger 162. At the second internal heat exchanger 162, heat is taken away from the intermediate pressure refrigerant flowing through the intermediate cooling loop 150, and a heating operation is conducted.

This situation is described by referring to FIG. 3. The refrigerant is evaporated by the evaporator 157 and then becomes low temperature status. The refrigerant is not completely in gas status, but is mixed with liquid. Because the refrigerant is made to pass through the first internal heat exchanger 160 to exchange heat with the refrigerant at the high pressure side, the entropy of the refrigerant is increased by Δh2, represented by status ① in FIG. 3. In this way, the refrigerant substantially becomes gas status completely. Furthermore, by making the refrigerant to pass through the second internal heat exchanger 162 to exchange heat with the intermediate pressure refrigerant, the entropy of the refrigerant is increased by Δh3, represented by status ① in FIG. 3.

In this manner, the refrigerant coming out of the evaporator 157 can be firmly gasified. Particularly, even though redundant refrigerant occurs due to a certain operation condition, since the refrigerant at the low pressure side is heated by two stages by using the first internal heat exchanger 160 and the second internal heat exchanger 162, a liquid back phenomenon that the liquid refrigerant is sucked back to the compressor 10 can be actually avoided without installing a receiver tank at the low pressure side. Therefore, inconvenience of the compressor 10 being damaged by the liquid compression can be avoided.

As described above, a heat exchange between the low pressure refrigerant, which is from the evaporator 157 and heated by the first internal heat exchanger 160, and the intermediate pressure refrigerant compressed by the first rotary compression element 32 is performed at the second internal heat exchanger 162. After the heat exchanger is performed between both refrigerants, the heat budge absorbed into the compressor 10 becomes zero since the both refrigerants are absorbed into the compressor 10.

Therefore, since a superheat degree can be sufficiently maintained without increasing the discharging temperature and the internal temperature of the compressor 10, the reliability of the transcritical refrigerant cycling device can be improved.

The cycle that the refrigerant heated by the second internal heat exchanger 162 is absorbed from the refrigerant introduction pipe 94 into the first rotary compression element 32 of the compressor 10 is repeated.

As described above, by equipping with the intermediate cooling loop 150 (for radiating heat of the refrigerant, which is discharged from the first rotary compression element 32, at the gas cooler 154), the first internal heat exchanger 160 (for exchanging heat between the refrigerant coming out of the gas cooler 154 from the second rotary compression element 34 and the refrigerant coming out of the evaporator 157), and the second heat exchanger 162 (for exchanging heat between the refrigerant coming out of the first internal heat exchanger 160 from the evaporator 157 and the refrigerant that comes out of the gas cooler 154 and flows through the intermediate cooling loop 150), the refrigerant coming out of the evaporator 157 exchanges heat at the first internal heat exchanger 160 with the refrigerant coming out of the gas cooler 154 from second rotary compression element 34 to absorb heat, and further exchanges heat at the second internal heat exchanger 162 with the refrigerant, which comes out of the gas cooler 154 and flows through the intermediate cooling loop 150, to absorb heat. Therefore, the superheat degree of the refrigerant can be firmly maintained and the liquid compression in the compressor 10 can be avoided.

Additionally, since heat of the refrigerant coming out of the gas cooler 154 from the second rotary compression element 34 is taken at the first internal heat exchanger 160 by the refrigerant coming out of the evaporator 157, the refrigerant temperature is reduced, so that the cooling ability for the refrigerant gas at the evaporator 157 is increased. Accordingly, a desired evaporation temperature can be easily achieved without increasing the refrigerant cycling amount, and the power consumption of the compressor 10 can be also reduced.

In addition, since the intermediate cooling loop 150 is disposed, the internal temperature of the compressor 10 can be reduced. Particularly, after heat of the refrigerant flowing through the intermediate cooling loop 150 is radiated at the gas cooler 154, because heat is provided to the refrigerant that comes from the evaporator 157 and the refrigerant is absorbed into the second rotary compression element 34, the internal temperature of the compressor 10 will not increase because of arranging the second internal heat exchanger 162.

In this embodiment, carbon dioxide is used as the refrigerant, but is not to limit the scope of the present invention. Various refrigerants that cab be used in the transcritical refrigerant cycle can be applied to the present invention.

Third Embodiment

Figure 4:
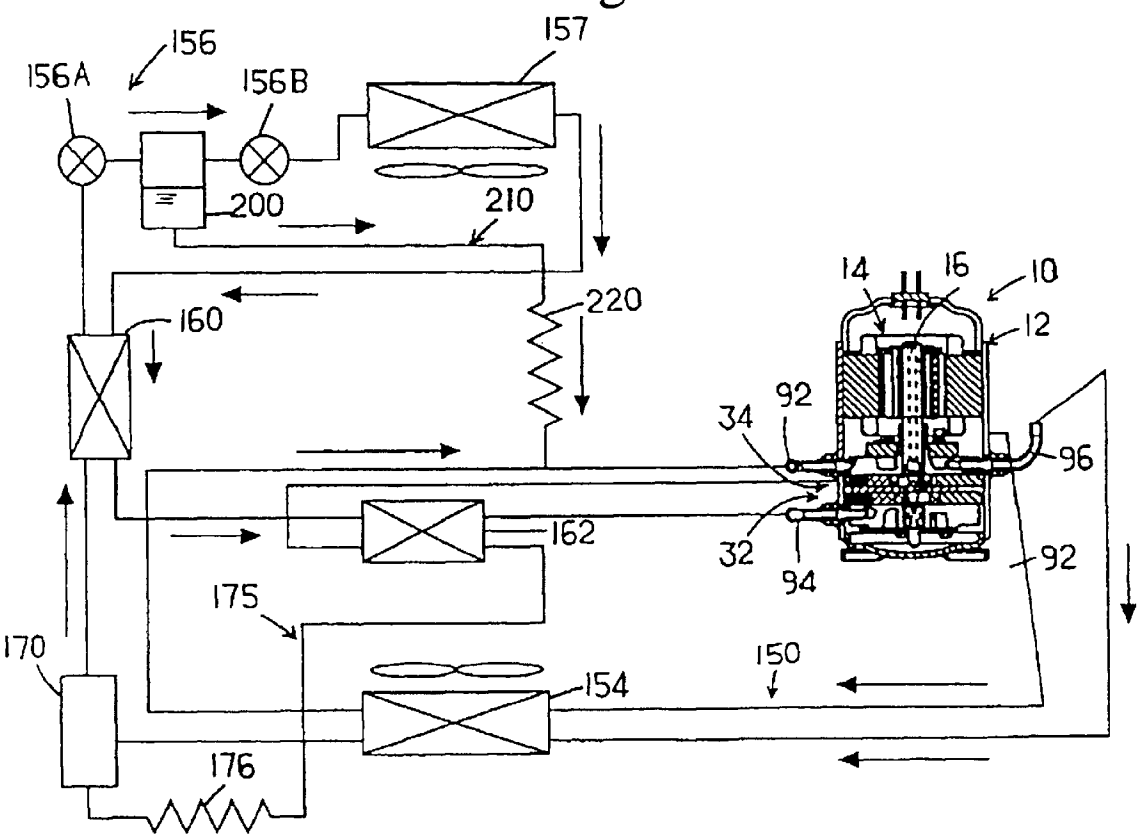
FIG. 4 is another refrigerant cycling loop according to a transcritical refrigerant cycling device of the present invention.

Referring to FIG. 4, the aforementioned compressor 10 forms a part of the refrigerant cycling loop. The refrigerant discharging pipe 96 of the compressor 10 is connected to the inlet of the gas cooler 154. The pipe coming out of the gas cooler 154 is connected to the inlet of an oil separator 170 that serves as an oil separating means. The oil separator 170 is used to separate the refrigerant compressed by the second rotary compression element 34 and a discharged oil.

A refrigerant pipe coming out of the oil separator 170 passes through the aforementioned first internal heat exchanger 160. The first internal heat exchanger 160 is used to exchange heat between the high pressure refrigerant coming out of the oil separator 170 from the second rotary compression element 34 and the low pressure refrigerant from the evaporator 157.

The refrigerant at the high pressure side, which passes through the first internal heat exchanger 160, then reaches the expansion mechanism 165 that serves as a throttling means. The expansion mechanism 156 comprises a first expansion valve 156A serving as a first throttling means and a second expansion valve 156B serving as a second throttling means, wherein the second expansion valve 156B is arranged at the lower stream side of the first expansion valve 156A. The first expansion valve 156A is used to adjust an aperture so that the pressure of the refrigerant that is reduced by the first expansion valve 156A is higher than the intermediate pressure in the compressor 10.

In addition, a gas-liquid separator 200 serving as a gas-liquid separating means is connected to refrigerant pipes between the first expansion valve 156A and the second expansion pipe 156B. The refrigerant pipe coming out of the first expansion valve 156A is connected to an inlet of the gas-liquid separator 200. The refrigerant pipe at the gas outlet of the gas-liquid separator 200 is connected to an inlet of the second expansion valve 156B. The outlet of the second expansion valve 156B is connected to the inlet of the evaporator 157, and the refrigerant pipe coming out of the evaporator 157 passes through the first internal heat exchanger 160 and then reaches the second internal heat exchanger 162. The refrigerant pipe coming out of the second heat exchanger 162 is then connected to the refrigerant introduction pipe 94.

An oil return loop 175 is connected to the oil separator 170 for returning the oil separated by the oil separator 170 back to the compressor 10. A capillary tube (serving as a pressure reduction means) 176 is arranged in the oil return loop 175 for reducing the pressure of the oil that is separated by the oil separator 170, and the oil return loop 175 passes through the second internal heat exchanger 162 to connect to the interior of the sealed container 12 of the compressor 10.

An injection loop 210 is connected to a liquid outlet of the gas-liquid separator 200 for returning liquid refrigerant separated from the gas-liquid separator 200 back to the compressor 10. A capillary tube (serving as a pressure reduction means) 220 is arranged in the injection loop 210 for reducing the pressure of the liquid refrigerant separated from the gas-liquid separator 200. The injection loop 210 is connected to the refrigerant introduction pipe 92 that is connected to the absorption side of the second rotary compression element 34.

Next, referring to FIGS. 1 and 4, the operation for the above transcritical refrigerant cycling device according the embodiment of the present invention is described in detail. As the stator coil 28 of the electrical motor element 14 of the compressor 10 is electrified through the terminal 20 and the wires (not shown), the electrical motor element 14 starts so that rotor 24 starts rotating. By this rotation, the upper and the lower roller 46, 48, which are embedded to the upper and the lower eccentric parts 42, 44 that are integrally disposed with the rotational shaft 16, rotate eccentrically within the upper and the lower cylinders 38, 40.

In this way, the low pressure refrigerant gas, which passes through the absorption passage 60 formed in the refrigerant introduction pipe 94 and the lower supporting member 56 and is absorbed from the absorption port into the low pressure chamber of the lower cylinder 40, is compressed due to the operation of the roller 48 and the valve 52, and then becomes intermediate pressure status. Thereafter, starting from the high-pressure chamber of the lower cylinder 40, the intermediate pressure refrigerant gas passes through a connection passage (not shown), and then discharges from the intermediate discharging pipe 121 into the sealed container 12. Accordingly, the interior space of the sealed container 12 becomes the intermediate pressure status.

The intermediate pressure refrigerant gas inside the sealed container 12 enters the refrigerant inlet pipe 92, and then flows into the intermediate cooling loop 150. In the process where the intermediate cooling loop 150 passes through the gas cooler 154, heat is radiated in an air cooling manner.

As described, by making the intermediate pressure refrigerant gas, which is compressed by the first rotary compression element 32, to pass through the intermediate cooling loop 150, the gas cooler 154 and the second internal heat exchanger 162 can cool the refrigerant effectively. Therefore, a temperature rising within the sealed container 12 can be suppressed, and additionally, the compression efficiency of the second rotary compression element 34 can be increased.

The cooled intermediate pressure refrigerant gas passes through an absorption passage formed in the upper supporting member 54, and then is absorbed from the absorption port into the low pressure chamber of the upper cylinder 38 of the second rotary compression element 34. By the operation of the roller 46 and the valve 50, the two-stage compression is performed, so that the refrigerant gas becomes high pressure and high temperature. Then, the high pressure and high temperature refrigerant goes to the discharging port from the high pressure chamber, passes through the discharging muffler chamber 62 formed in the upper supporting member 55, and then discharges from the refrigerant discharging pipe 96 to the external. At this time, the refrigerant gas is properly compressed to a hyper critical pressure.

The refrigerant gas discharged from the refrigerant discharging pipe 96 flows into the gas cooler 154, at which heat is radiated in an air cooling manner. Afterwards, the refrigerant gas reaches the oil separator 170, at which the oil and the refrigerant gas are separated from each other.

The oil separated from the refrigerant gas flows into the oil return loop 175. After the oil is depressurized by the capillary tube 176 arranged in the oil return loop 175, the oil returns back to the interior of the sealed container 12 of the compressor 10.

As described, since the cooled oil returns back to the interior of the sealed container 12 of the compressor 10, the interior of the sealed container 12 can be effectively cooled by the oil. Therefore, the temperature rising of the internal space of the sealed container 12 can be suppressed and the compression efficiency of the second rotary compression element 34 can be increased.

In addition, a disadvantage that an oil level of the oil accumulator in the sealed container 12 is decreased can be avoided.

Furthermore, the refrigerant gas coming out of the oil separator 170 passes through the first internal heat exchanger 160. At the first internal heat exchanger 160, heat of the refrigerant gas is taken away by the refrigerant at the low pressure side, so that the refrigerant gas is further cooled. As a result, the evaporation temperature of the refrigerant at the evaporator 157 gets lower, so that the cooling ability of the evaporator 157 is increased and improved.

The refrigerant gas at the high pressure side, which is cooled by the first internal heat exchanger 160, reaches the first expansion valve 156A. The refrigerant gas is still in gas status at the inlet of the expansion valve 156A. As described above, the first expansion valve 156A adjusts an aperture so that the pressure of the refrigerant is higher than the pressure (the intermediate pressure) at the absorption side of the second rotary compression element 34 of the compressor 10, and the refrigerant is depressurized until the refrigerant has a pressure higher than the intermediate pressure. In this way, a portion of the refrigerant is liquidized, and thus the refrigerant becomes a two-phase mixture of gas and liquid. This two-phase mixture refrigerant then flows into the gas-liquid separator 200, at which the gas refrigerant and the liquid refrigerant are separated from each other.

The liquid refrigerant in the gas-liquid separator 200 flows into the injection loop 210, and then is depressurized by the capillary tube 220 that is arranged in the injection loop 210. In this manner, the liquid refrigerant possesses a pressure slightly higher than the intermediate pressure. Passing through the refrigerant introduction pipe 92, the refrigerant is then injected into the absorption side of the second rotary compression element 34 of the compressor 10 where the refrigerant evaporates. By absorbing heat from the environment, the cooling operation is conducted. In this way, the compressor 10 itself, including the second rotary compression element 34, is cooled.

As described, the liquid refrigerant is depressurized in the injection loop 210, and then is injected into the absorption side of the second rotary compression element 34 of the compressor 10 where the liquid refrigerant evaporates, so that the second rotary compression element 34 is cooled. Therefore, the second rotary compression element 34 can be effectively cooled. In this manner, the compression efficiency of the second rotary compression element 34 can be increased and improved.

In addition, the gas refrigerant coming out of the gas-liquid separator 200 reaches the second expansion valve 156B. A final liquidization is performed to the refrigerant by the pressure reduction at the second expansion valve 156B. The refrigerant with the two-phase mixture of gas and liquid flows into the evaporator 157, at which the refrigerant is evaporated to perform a cooling operation by absorbing heat from the air.

As described above, by and effect that the intermediate pressure refrigerant gas compressed by the first rotary compression element 32 is made to pass through the intermediate cooling loop 150 to suppress the temperature rising in the sealed container, by an effect that the oil separated from the refrigerant gas by the oil separator 170 is made to pass through the second internal heat exchanger 162 to suppress the temperature rising in the sealed container 12, and further by an effect that the gas refrigerant and the liquid refrigerant are separated by the gas-liquid separator 200, the separated liquid refrigerant is depressurized by the capillary tube 220, and then the refrigerant absorbs heat from ambience at the second rotary compression element 34 to evaporate so as to cool the second rotary compression element 34, the compression efficiency of the second rotary compression element 34 can be improved. In addition, by an effect that the refrigerant gas compressed by the second rotary compression element 34 is made to pass through the first internal heat exchanger 160 to reduce the refrigerant temperature at the evaporator 157, the cooling ability at the evaporator 157 can be considerably increased and improved, and the power consumption of the compressor 10 can be also reduced.

Namely, in this case, the evaporation temperature at the evaporator 157 can be easily reaches an extreme low temperature range, for example, less than or equal to −50° C. In addition, the power consumption of the compressor 10 can be also reduced.

Afterwards, the refrigerant flows out of the evaporator 157, and then passes through the first internal heat exchanger 160. At the first heat exchanger 160, the refrigerant takes heat from the refrigerant at the high pressure side to receive a heating operation, and then reaches the second internal heat exchanger 162. The refrigerant further takes heat at the second internal heat exchanger 162 from the oil flowing through the oil return loop 175 so as to further receive a heating operation.

The refrigerant is evaporated by the evaporator 157 and then becomes low temperature status. The refrigerant is not completely in gas status, but is mixed with liquid. However, by passing through the first internal heat exchanger 160 to exchange heat with the refrigerant at the high pressure side, the refrigerant is heated. In this way, the refrigerant substantially becomes gas status completely. Furthermore, by making the refrigerant to pass through the second internal heat exchanger 162 to exchange heat with the oil, the refrigerant is heated. An super heat degree is actually obtained, so that the refrigerant becomes gas completely.

In this manner, the refrigerant coming out of the evaporator 157 can be firmly gasified. Particularly, even though redundant refrigerant occurs due to a certain operation condition, since the refrigerant at the low pressure side is heated by two stages by using the first internal heat exchanger 160 and the second internal heat exchanger 162, a liquid back phenomenon that the liquid refrigerant is sucked back to the compressor 10 can be actually avoided without installing a receiver tank at the low pressure side. Therefore, inconvenience of the compressor 10 being damaged by the liquid compression can be avoided.

Therefore, since a superheat degree can be sufficiently maintained without increasing the discharging temperature and the internal temperature of the compressor 10, the reliability of the transcritical refrigerant cycling device can be improved.

The cycle that the refrigerant heated by the second internal heat exchanger 162 is absorbed from the refrigerant introduction pipe 94 into the first rotary compression element 32 of the compressor 10 is repeated.

As described above, the intermediate cooling loop 150 (for radiating heat of the refrigerant, which is discharged from the first rotary compression element 32, at the gas cooler 154), the oil separator 170 for separating the oil from the refrigerant compressed by the second rotary compression element 34, the oil return loop 175 for depressurizing the oil separated from the oil separator 170 and then returning the oil back to the compressor 10, the first internal heat exchanger 160 (for exchanging heat between the refrigerant coming out of the gas cooler 154 from the second rotary compression element 34 and the refrigerant coming out of the evaporator 157), and the second heat exchanger 162 (for exchanging heat between the refrigerant coming out of the first internal heat exchanger 160 from the evaporator 157 and the oil that flows in the oil return loop 175) are installed. In addition, the expansion mechanism 156 serving as the throttling means is constructed by the first expansion valve 156A and the second expansion valve 156B that is arranged at the downstream side of the first expansion valve 156A. Furthermore, the injection loop 210 is arranged for depressurizing a portion of the refrigerant flowing between the first expansion valve 156A and the second expansion valve 156B and then injecting the refrigerant into the absorption side of the second rotary compression element 34 of the compressor 10. Under these structure, the refrigerant coming out of the evaporator 157 exchanges heat at the first internal heat exchanger 160 with the refrigerant coming out of the gas cooler 154 from second rotary compression element 34 to absorb heat, and further exchanges heat at the second internal heat exchanger 162 with the oil that flows in the oil return loop 175 to absorb heat. Therefore, the superheat degree of the refrigerant can be firmly maintained and the liquid compression in the compressor 10 can be avoided.

In addition, after passing through the oil separator 170, since the refrigerant coming out of the evaporator 157 takes heat from the refrigerant coming out of the gas cooler 154 from the second rotary compression element 34, the evaporation temperature of the refrigerant is reduced. In this manner, the cooling ability of the refrigerant gas at the evaporator 157 is increased. Furthermore, since the intermediate cooling loop 150 is disposed, the internal temperature of the compressor 10 can be reduced.

Moreover, after heat of the oil flowing through the oil return loop 175 is taken by the refrigerant coming out of the first internal heat exchanger 160 from the evaporator 157, the oil returns back to the compressor 10. Therefore, the internal temperature of the compressor 10 can be further reduced.

Furthermore, the gas-liquid separator 200 is disposed between the first expansion valve 156A and the second expansion valve 156B. The injection loop 210 depressurizes the liquid refrigerant separated from the gas-liquid separator 200, and then injects the liquid refrigerant into the absorption side of the second rotary compression element 34 of the compressor 10. Therefore, the refrigerant from the injection loop 210 evaporates and absorbs heat from the environment, so that the entire compressor, including the second rotary compression element 34, can be effectively cooled. In this manner, the evaporation temperature of the refrigerant at the evaporator 157 of the refrigerant cycle can be further reduced.

Accordingly, it is possible to reduce the evaporation temperature of the refrigerant at the evaporator 157 of the refrigerant cycling loop. For example, the evaporation temperature at the evaporator 157 can easily achieve an extreme low temperature range less than or equal to −50° C. Additionally, the power consumption of the compressor 10 can be also reduced.

Fourth Embodiment

Figure 5:
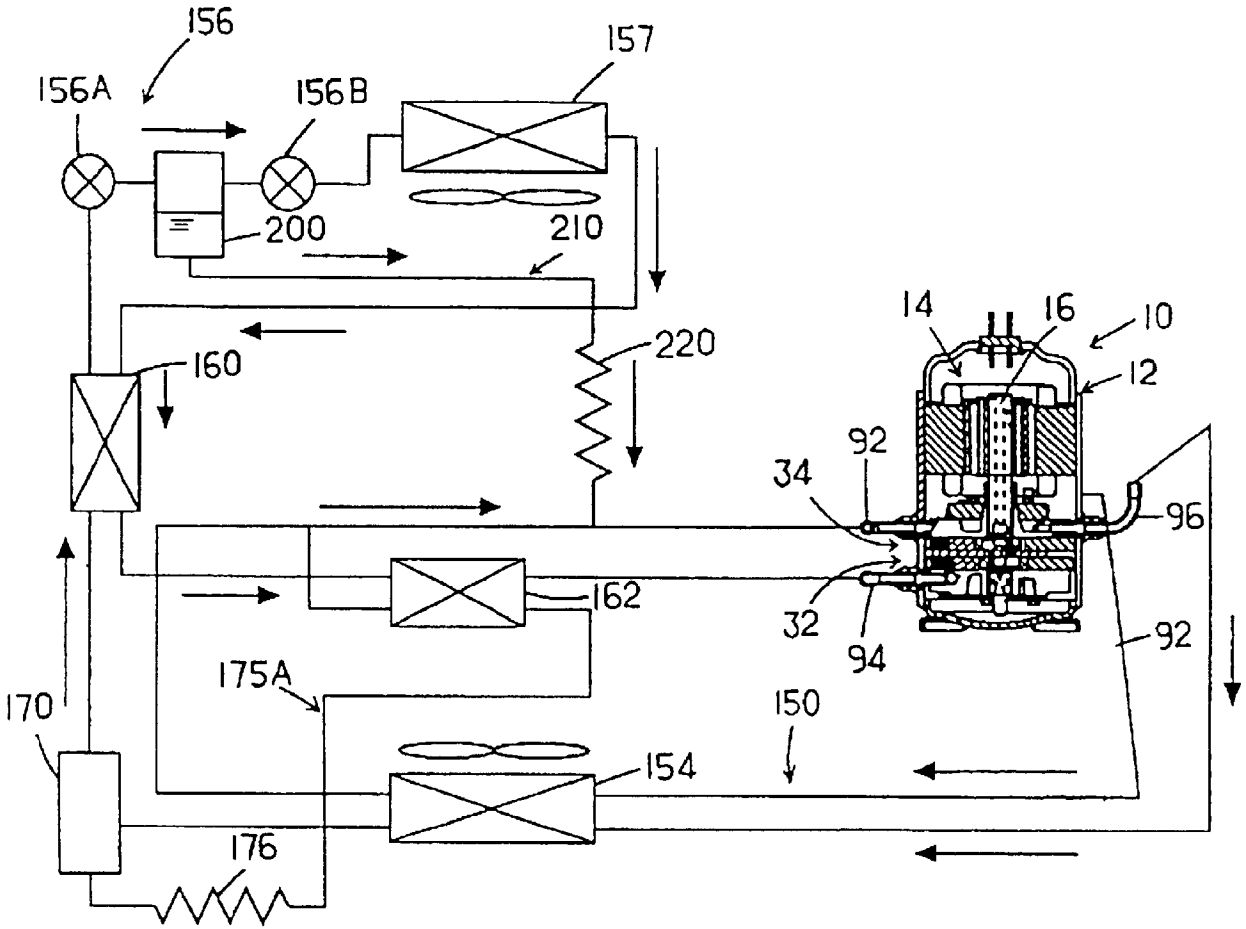
FIG. 5 is another refrigerant cycling loop according to a transcritical refrigerant cycling device of the present invention.

In FIG. 5, a capillary tube 176 is also arranged in an oil return loop 175A. But, in this embodiment, the oil return loop 175A passes through the second internal heat exchanger 162 and then is connected to the refrigerant introduction pipe 92 that is connected to a absorption passage (not shown) of the upper cylinder 38 of the second rotary compression element 34. In this way, the oil cooled by the second internal heat exchanger 162 is supplied to the second rotary compression element 34.

As described, the oil return loop 175A depressurizes the oil separated from the oil separator 170 by using the capillary tube 176. After the oil exchanges heat at the second internal heat exchanger 162 with the refrigerant coming out of the first internal heat exchanger 160 from the evaporator 157, the oil returns from the refrigerant introduction pipe 92 back to the absorption side of the second rotary compression element 34 of the compressor 10.

In this way, the second rotary compression element 34 can be effectively cooled, and thus the compression efficiency of the second rotary compression element 34 can be increased and improved.

In addition, since the oil is directly supplied to the second rotary compression element 34, a disadvantage of insufficient oil for the second rotary compression element 34 can be avoided.

In this embodiment, the liquid refrigerant separated by the gas-liquid separator 200 is depressurized by the capillary tube 220 arranged in the injection loop 210, and then returns from the refrigerant introduction pipe 92 back to the absorption side of the second rotary compression element 34. But, the gas-liquid separator 200 can be also not installed. In this case, the refrigerant coming out of the first expansion valve 156A (without the gas-liquid separator, the refrigerant may be in gas or liquid status, or their mixed status) is depressurized to a suitable pressure (slightly higher than the intermediate pressure) by the capillary tube 220 arranged in the injection loop 210, and then the depressurized refrigerant returns from the refrigerant introduction pipe 92 back to the absorption side of the second rotary compression element 34.

Furthermore, the refrigerant coming out of the first expansion valve 156A is depressurized to a suitable pressure (slightly higher than the intermediate pressure). In this case, if the refrigerant is in gas status, it is not necessary to dispose the capillary tube 220.

In this embodiment, the oil separator (serving as the oil separating means) 170 is arranged in the refrigerant pipe between the gas cooler 154 and the first internal heat exchanger 160, but this configuration is not used to limit the scope of the present invention. For example, the oil separator can be also arranged in the refrigerant pipe between the compressor 10 and the gas cooler 154. In addition, the capillary tube (serving as a depressurization means) 176 arranged in the oil return loop 175 can be also wound on the refrigerant pipe from the first internal heat exchanger 160 for thermal conduction to construct the second internal heat exchanger 162.

Furthermore, in this embodiment, carbon dioxide is used as the refrigerant, but this is not used to limit the scope of the present invention. Various refrigerant that can be used in the transcritical refrigerant cycling loop can be used, for example, R23 ($CHF_3$) or nitrous suboxide ($N_2O$) of HFC refrigerant that becomes supercritical at the high pressure side. In addition, when R23 ($CHF_3$) or nitrous suboxide ($N_2O$) refrigerant of HFC refrigerant is used, the evaporation temperature of the refrigerant at the evaporator can reach an extreme low temperature equal to or less than −80° C.

Fifth Embodiment

Figure 6:
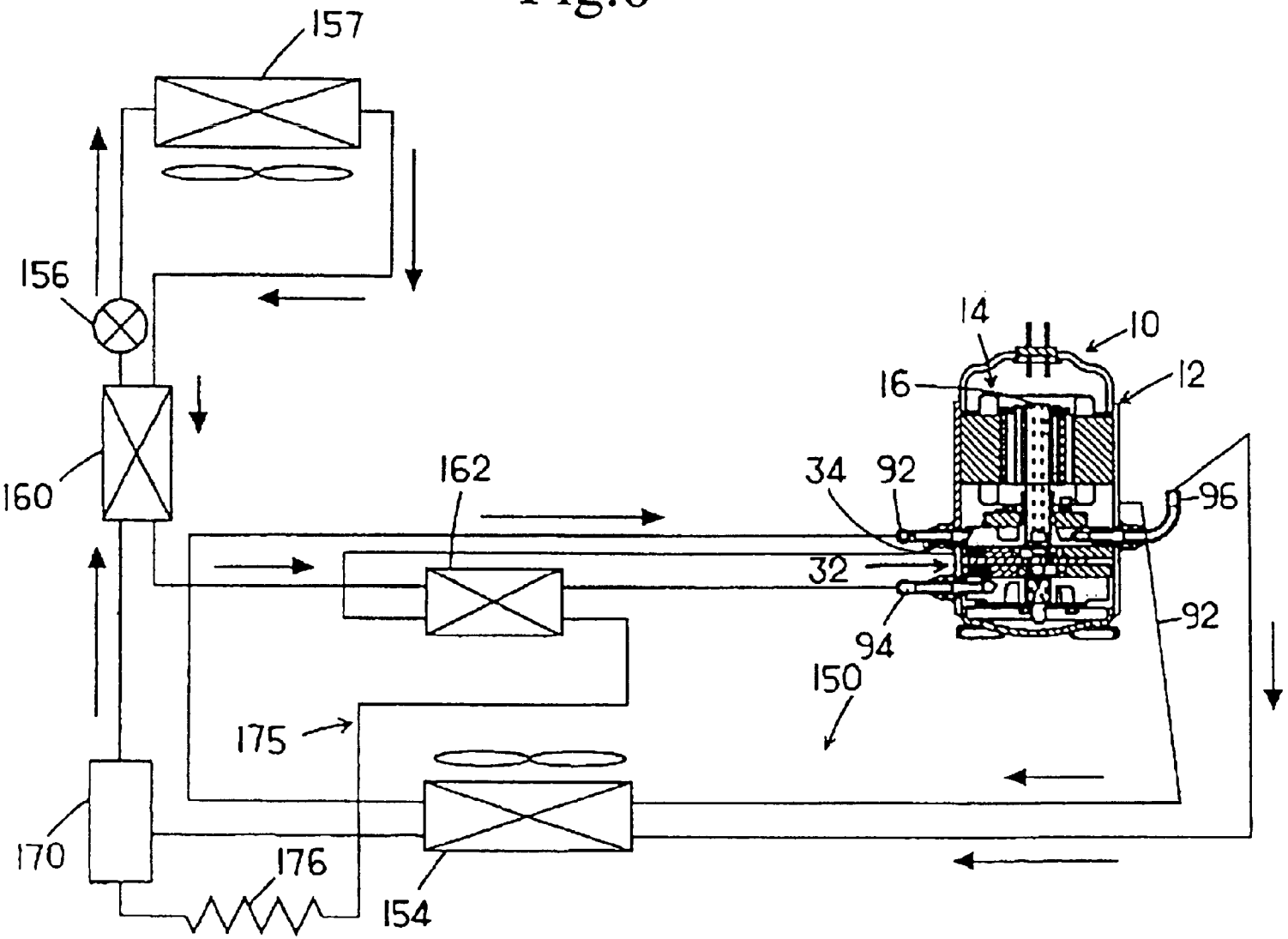
FIG. 6 is another refrigerant cycling loop according to a transcritical refrigerant cycling device of the present invention.

Next, a transcritical refrigerant cycling device according to the fifth embodiment of the present invention is described in detail by referring to FIG. 6. In FIG. 6, the same numbers as in FIGS. 1 and 5 have the same or similar functions.

The differences of the transcritical refrigerant cycling devices between FIGS. 5 and 6 are that the refrigerant at the high pressure side, passing through the first internal heat exchanger 160, reaches the expansion valve 156 (serving as the throttling means). The outlet of the expansion valve 156 is connected to the inlet of the evaporator 157, and the refrigerant pipe coming out of the evaporator 157 passes through the first internal heat exchanger 160 and then reaches the second heat exchanger 162. The refrigerant pipe coming out of the second internal heat exchanger 162 is connected to the refrigerant introduction pipe 94.

The refrigerant gas at the high pressure side, which is cooled by the first internal heat exchanger 160, reaches the expansion valve 156. The refrigerant gas at the inlet of the expansion valve 156 is still in gas status. The refrigerant then becomes a two-phase mixture of gas and liquid due to a pressure reduction at the expansion valve 156. With the mixed status, the refrigerant flows into the evaporator 157, at which the refrigerant evaporates and conducts a cooling operation by absorbing heat from the air.

At this time, the compression efficiency of the second rotary compression element 34 can be increased due to an effect of making the intermediate pressure refrigerant gas compressed by the first rotary compression element 32 to pass through the intermediate cooling loop 150 to suppress the temperature rising in the sealed container 12 and an effect of making the oil separated from the refrigerant gas by the oil separator 170 to pass through the second internal heat exchanger 162 to suppress the temperature rising in the sealed container 12. In addition, the evaporation temperature of the refrigerant at the evaporator 157 can be reduced due to an effect of making the refrigerant gas compressed by the second rotary compression element 34 to pass through the first internal heat exchanger 160 to reduce the refrigerant temperature at the evaporator 157.

In this case, the evaporation temperature at the evaporator 157 can reach a low temperature range of −30° C. to −40° C., for example. Additionally, the consumption power of the compressor 10 can be further reduced.

Afterwards, the refrigerant flows out of the evaporator 157, passes through the first internal heat exchanger 160 where the refrigerant takes heat from the refrigerant at the high pressure side for receiving a heating operation, and then reaches the second internal heat exchanger 162. Next, the refrigerant takes heat at the second heat exchanger 162 from the oil that flows in the oil return loop 175, so as to further receive a heating operation.

The refrigerant evaporates at the evaporator 157 and becomes low temperature. The refrigerant coming out of the evaporator 157 is not completely a gas state, but is in a status mixed with liquid. However, by making the refrigerant to pass through the first internal heat exchanger 160 to exchange heat with the refrigerant at the high pressure side, the refrigerant is heated. In this manner, the refrigerant almost becomes gas status. Furthermore, the refrigerant is further heated by making the refrigerant to pass through the second internal heat exchanger 162 to exchange heat with the oil, so that an superheat degree can be firmly obtained and the refrigerant becomes gas completely.

Accordingly, the refrigerant coming out of the evaporator 157 can be firmly gasified. In particularly, even though redundant refrigerant occurs due to a certain operation condition, since the refrigerant at the low pressure side is heated by two stages by using the first internal heat exchanger 160 and the second internal heat exchanger 162, a liquid back phenomenon that the liquid refrigerant is sucked back to the compressor 10 can be actually avoided without installing a receiver tank at the low pressure side. Therefore, inconvenience of the compressor 10 being damaged by the liquid compression can be avoided.

Therefore, since a superheat degree can be sufficiently maintained without increasing the discharging temperature and the internal temperature of the compressor 10, the reliability of the transcritical refrigerant cycling device can be improved.

The cycle that the refrigerant heated by the second internal heat exchanger 162 is absorbed from the refrigerant introduction pipe 94 into the first rotary compression element 32 of the compressor 10 is repeated.

As described above, the intermediate cooling loop 150 (for radiating heat of the refrigerant, which is discharged from the first rotary compression element 32, at the gas cooler 154), the first internal heat exchanger 160 (for exchanging heat between the refrigerant coming out of the gas cooler 154 from the second rotary compression element 34 and the refrigerant coming out of the evaporator 157), the oil separator 170 for separating the oil from the refrigerant compressed by the second rotary compression element 34, the oil return loop 175 for depressurizing the oil separated from the oil separator 170 and then returning the oil back to the compressor 10, and the second heat exchanger 162 (for exchanging heat between the refrigerant coming out of the first internal heat exchanger 160 from the evaporator 157 and the oil that flows in the oil return loop 175) are installed. The refrigerant coming out of the evaporator 157 exchanges heat at the first internal heat exchanger 160 with the refrigerant coming out of the gas cooler 154 from second rotary compression element 34 to absorb heat, and further exchanges heat at the second internal heat exchanger 162 with the oil that flows in the oil return loop 175 to absorb heat. Therefore, the superheat degree of the refrigerant can be firmly maintained and the liquid compression in the compressor 10 can be avoided.

In addition, after passing through the oil separator 170, since the refrigerant coming out of the evaporator 157 takes heat from the refrigerant coming out of the gas cooler 154 from the second rotary compression element 34, the evaporation temperature of the refrigerant is reduced. In this manner, the cooling ability of the refrigerant gas at the evaporator 157 is increased. Furthermore, since the intermediate cooling loop 150 is disposed, the internal temperature of the compressor 10 can be reduced.

Moreover, after heat of the oil flowing through the oil return loop 175 is taken by the refrigerant coming out of the first internal heat exchanger 160 from the evaporator 157, the oil returns back to the compressor 10. Therefore, the internal temperature of the compressor 10 can be further reduced.

Accordingly, it is possible to reduce the evaporation temperature of the refrigerant at the evaporator 157 of the refrigerant cycling loop. For example, the evaporation temperature at the evaporator 157 can easily achieve a low temperature range of −30° C. to −40° C. Additionally, the power consumption of the compressor 10 can be also reduced.

Sixth Embodiment

Figure 7:
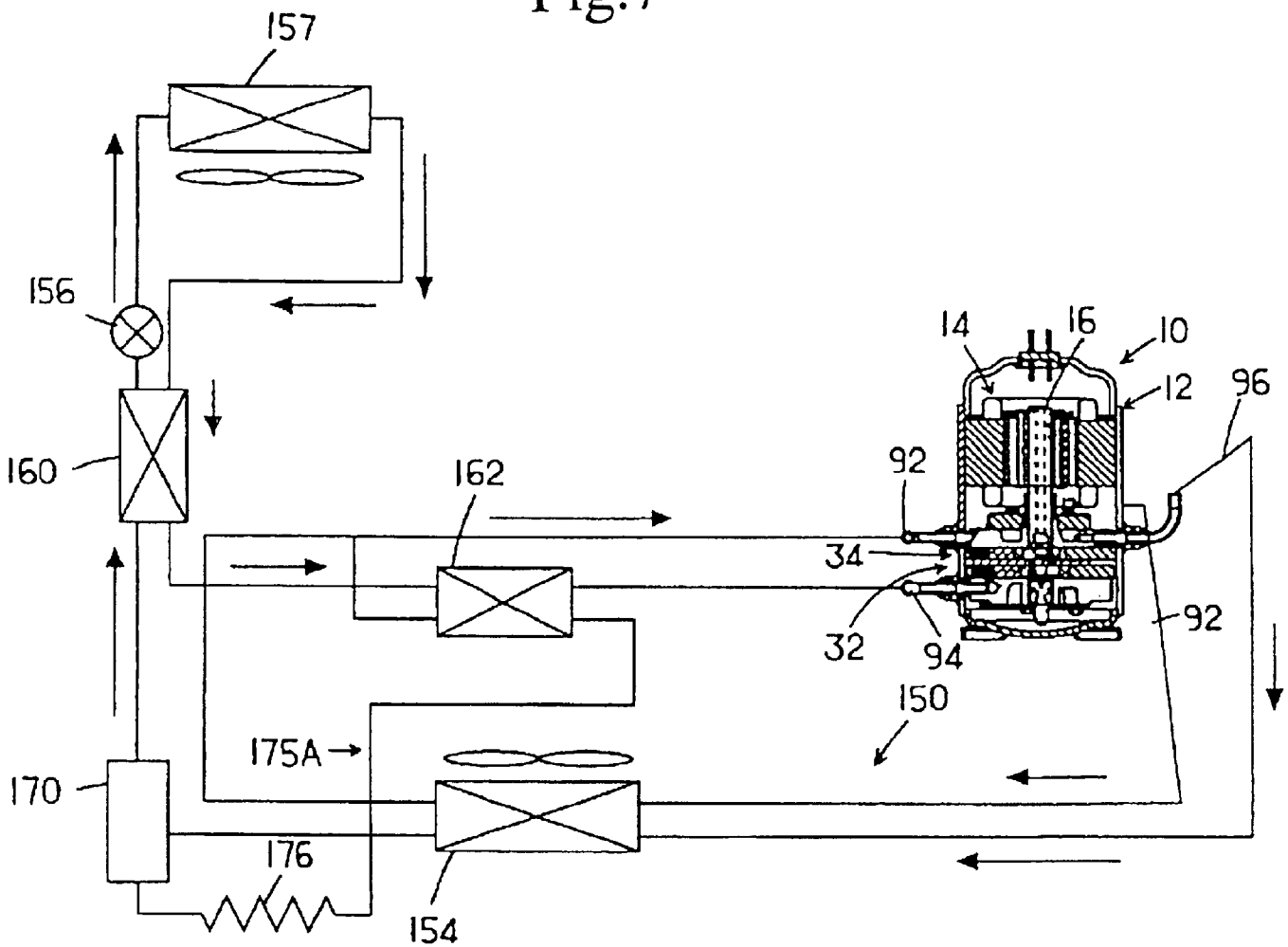
FIG. 7 is another refrigerant cycling loop according to a transcritical refrigerant cycling device of the present invention.

Next, a transcritical refrigerant cycling device according to the sixth embodiment of the present invention is described in detail by referring to FIG. 7. In FIG. 7, the same numbers as in FIGS. 1 and 6 have the same or similar functions.

The differences between the structures of FIGS. 6 and 7 are described as follows. As shown FIG. 7, a capillary tube 176 is similarly arranged in the oil return loop 175A. However, in this case, the oil return loop 175A passes through the second internal heat exchanger 162 and then is connected to the refrigerant introduction pipe 92 that is connected to a absorption passage (not shown) of the upper cylinder 38 of the second rotary compression element 34. In this way, the oil cooled by the second internal heat exchanger 162 is supplied to the second rotary compression element 34.

As described, the oil return loop 175A depressurizes the oil separated from the oil separator 170 by using the capillary tube 176. After the oil exchanges heat at the second internal heat exchanger 162 with the refrigerant coming out of the first internal heat exchanger 160 from the evaporator 157, the oil returns from the refrigerant introduction pipe 92 back to the absorption side of the second rotary compression element 34 of the compressor 10.

In this way, the second rotary compression element 34 can be effectively cooled, and thus the compression efficiency of the second rotary compression element 34 can be increased and improved.

In addition, since the oil is directly supplied to the second rotary compression element 34, a disadvantage of insufficient oil for the second rotary compression element 34 can be avoided.

In this embodiment, the oil separator (serving as the oil separating means) 170 is arranged in the refrigerant pipe between the gas cooler 154 and the first internal heat exchanger 160, but this configuration is not used to limit the scope of the present invention. For example, the oil separator can be also arranged in the refrigerant pipe between the compressor 10 and the gas cooler 154. In addition, the capillary tube (serving as a depressurization means) 176 arranged in the oil return loop 175 can be also wound on the refrigerant pipe from the first internal heat exchanger 160 for thermal conduction to construct the second internal heat exchanger 162.

Furthermore, in this embodiment, carbon dioxide is used as the refrigerant, but this is not used to limit the scope of the present invention. Various refrigerant that can be used in the transcritical refrigerant cycling loop can be used, for example, nitrous suboxide ($N_2O$).

Seventh Embodiment

Figure 8:
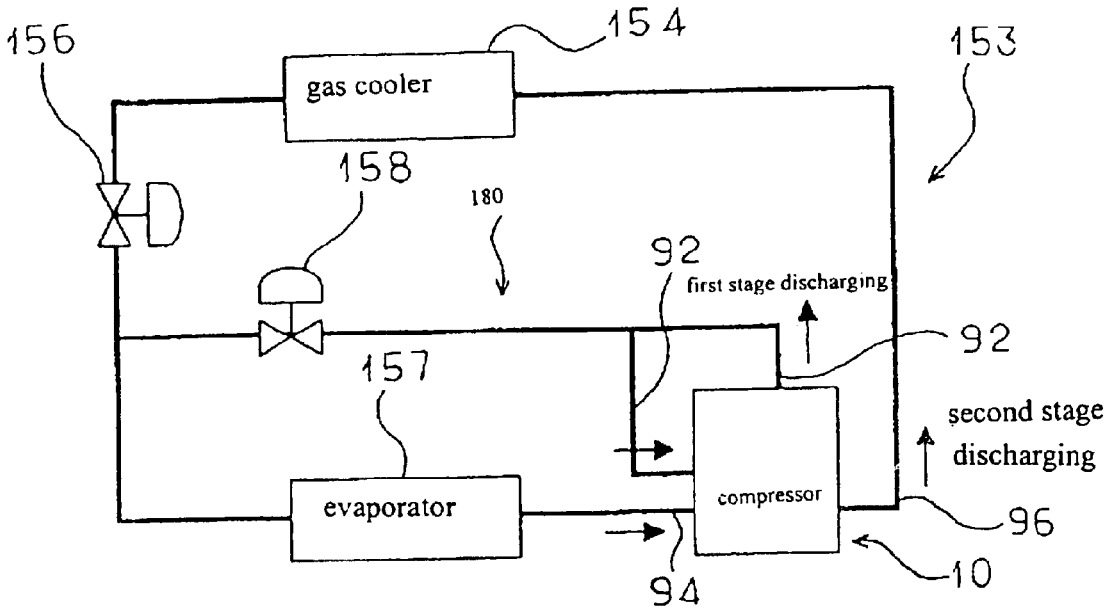
FIG. 8 is another refrigerant cycling loop according to a transcritical refrigerant cycling device of the present invention.

FIG. 8 shows the seventh embodiment of the present invention. In FIG. 8, the aforementioned compressor 10 (FIG. 1) forms a part of a refrigerant cycling loop of a hot water supplying device 153. The refrigerant discharging pipe 96 of the compressor 10 is connected to the inlet of the gas cooler 154. The pipe coming out of the gas cooler 154 reaches the expansion valve 156, as a throttling means. The outlet of the expansion valve 156 is connected to the inlet of the evaporator 157, and the pipe coming out of the evaporate 157 is connected to the refrigerant introduction pipe 94.

In addition, a bypass loop 180 is branched from the midway of the refrigerant introduction pipe 92. The bypass loop 180 is a loop for providing the intermediate pressure refrigerant gas, which is compressed by the first rotary compression element 32 and discharged into the sealed container 12, to the evaporator 157 without depressurizing by using the expansion valve 156. The bypass loop 180 is connected to the refrigerant pipe between the expansion valve 156 and the evaporator 157. In addition, an electromagnetic valve 158 (serving as a valve device) for switching the passage of the bypass loop 180 is arranged on the bypass loop 180

The operation of the refrigerant cycling loop with the above configuration according to the eighth embodiment of the present invention is described in detail as follows. In addition, the electromagnetic valve 158 is closed by a control device (not shown) before the compressor 10 is started.

Referring to FIGS. 1 and 8, as the stator coil 28 of the electrical motor element 14 of the compressor 10 is electrified through the terminal 20 and the wires (not shown), the electrical motor element 14 starts so that rotor 24 starts rotating. By this rotation, the upper and the lower roller 46, 48, which are embedded to the upper and the lower eccentric parts 42, 44 that are integrally disposed with the rotational shaft 16, rotate eccentrically within the upper and the lower cylinders 38, 40.

In this way, the low pressure refrigerant gas, which passes through the absorption passage 60 formed in the refrigerant introduction pipe 94 and the lower supporting member 56 and is absorbed from the absorption port into the low pressure chamber of the lower cylinder 40, is compressed due to the operation of the roller 48 and the valve 52, and then becomes intermediate pressure status. Thereafter, starting from the high-pressure chamber of the lower cylinder 40, the intermediate pressure refrigerant gas passes through a connection passage (not shown), and then discharges from the intermediate discharging pipe 121 into the sealed container 12. Accordingly, the interior space of the sealed container 12 becomes the intermediate pressure status.

The intermediate pressure refrigerant gas in the sealed container 12 passes through the refrigerant introduction pipe 92 and the absorption passage (not shown) formed in the upper supporting member 54. Subsequently, the refrigerant gas is absorbed into a low pressure chamber of the upper cylinder 38 of the second rotary compression element 34 from an absorption port (not shown). A two-stage compression is performed due to the operation of the roller 46 and the valve 50, so that the intermediate pressure refrigerant gas becomes a high pressure and temperature refrigerant gas. Then, from the high pressure chamber, the high pressure and temperature refrigerant gas goes to a discharging port (not shown), passes through the discharging muffler 62 formed in the upper supporting member 54, and discharges to the external via the refrigerant discharging pipe 96.

The refrigerant gas, which is discharged from the refrigerant discharging pipe 96, flows into the gas cooler 54 where heat of the refrigerant is radiated, and then reaches the expansion valve 156. The refrigerant gas is depressurized at the expansion valve 156, and then flows into the evaporator 157, at which the refrigerant gas absorbs heat from the environment. Afterwards, the refrigerant gas is absorbed into the first rotary compression element 32 from refrigerant introduction pipe 94. This refrigerant cycle is repeated.

In addition, the evaporator 157 will frost due to a long time operation. In this situation, the electromagnetic valve 158 is open by a control device (not shown), and the by pass loop 180 is open to execute a defrosting operation for the evaporator 157. In this way, the intermediate pressure refrigerant gas in the sealed container 12 flows to the downstream side of the expansion valve 156 and will not be depressurized, so that the intermediate pressure refrigerant gas flows into the evaporator 157 directly. Namely, the intermediate pressure refrigerant gas with a higher temperature will be directly supplied to the evaporator 157 without being depressurized. In this way, the evaporator 157 is heated and thus defrosted.

In the case that the high pressure refrigerant discharged from the second rotary compression element 34 is not depressurize and directly supplied to defrost the evaporator 157, since the expansion 156 is fully open, the absorption pressure of the first rotary compression element 32 is increased. Therefore, the discharging pressure (the intermediate pressure) of the first rotary compression element 32 gets high. The refrigerant goes through the second rotary compression element 34 and is discharged. However, since the expansion valve 156 is fully open, the discharging pressure of the second rotary compression element 34 might become the same as the discharging pressure of the first rotary compression element 32. A pressure inversion phenomenon of the discharging pressure (the high pressure) and the absorption pressure (the intermediate pressure) of the second rotary compression element 34 will occur. However, as describe above, because the intermediate pressure refrigerant gas discharged from the first rotary compression element 32 is taken out of the sealed container 12 to defrost the evaporator 157, the inversion phenomenon between the high pressure and the intermediate pressure during the defrosting operation can be avoided.

Figure 9:
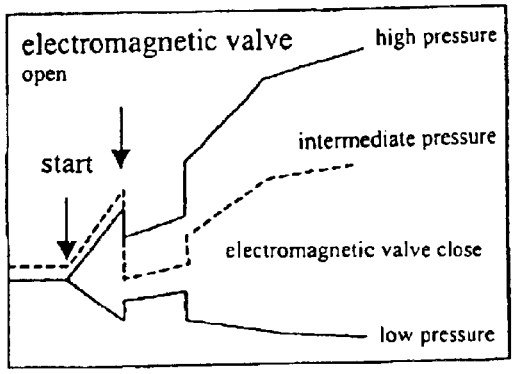
FIG. 9 shows a pressure behavior diagram when the compressor of the refrigerant cycling device starts.

FIG. 9 shows a pressure behavior when the compressor 10 of the refrigerant cycling device starts. As shown in FIG. 9, when the compressor 10 stops its operation, the expansion valve 156 is fully open. In this way, the low pressure (the pressure at the absorption side of the first rotary compression element 32) and the high pressure (the pressure at the discharging side of the second rotary compression element 34) in the refrigerant cycling loop are uniformed (represented by a solid line) before the compressor 10 starts. However, the intermediate pressure (dash line) in the sealed container 12 is not immediately equalized, as described above, the pressure at the lower pressure side will be higher that the pressure at the high pressure side.

In the present invention, after the compressor 10 is started, the electromagnetic valve 158 is open by a control device (not shown) after a predetermined time passes, so that the passage of the bypass loop 180 is open. Therefore, a portion of the refrigerant, which is compressed by the first rotary compression element 32 and discharged into the sealed container 12, departures from the refrigerant introduction 92 to the bypass loop 180, and then flows to the evaporator 157.

When the refrigerant that is compressed by the first rotary compression element 32 and discharged into the sealed container 12 does not escape from the bypass loop 180 to the evaporator 157, if the compressor 10 is operated under this condition, the pressure at the discharging side of the second rotary compression element 34, which adds a back pressure to the valve 50 of the second rotary compression element 34, and the pressure at the absorption side of the second rotary compression element 34 (the intermediate pressure in the sealed container 12) are the same, or the pressure at the absorption side of the second rotary compression element 34 becomes higher. As a result, there does not exist a force that energizes the valve 50 to the roller 46 side, and the valve will fly. Accordingly, since only the first rotary compression element 32 conducts a compression in the compressor 10 and the compression efficiency gets worse, the coefficient of product (COP) of the compressor is decreased.

In addition, a pressure difference between the pressure at the absorption side of the first rotary compression element 32 (the low pressure) and the intermediate pressure in the sealed container 12 (that adds the back pressure to the valve 52 of the first rotary compression element 32) becomes larger than a necessary value, a surface pressure will obviously act to a sliding portion between the front end of the valve 52 and the outer circumference of the roller 48, so as to wear the valve 52 and the roller 48. For a worst case, there is a danger to cause destroying the compressor.

Furthermore, as the intermediate pressure in the sealed container 12 increases too much, the electrical motor element 14 will be in a high temperature environment, and therefore, malfunctions of the compressor 10 for absorbing, compressing and discharging the refrigerant might occur.

However, as described above, in the case that the intermediate pressure refrigerant discharged from the first rotary compression element 32 escapes from the sealed container 12 to the evaporator 157 through the bypass loop 180, the inversion phenomenon can be prevented since the intermediate pressure reduces repeatedly, and becomes lower than the high pressure (referring to FIG. 9).

In this manner, since the aforementioned unstable operation behavior of the compressor 10 can be avoided, the performance and the durability of the compressor 10 can be increased and improved. Therefore, stabilized operation condition at the refrigerant cycling loop device can be maintained, and the reliability of the refrigerant cycling loop device can be increased and improved.

In addition, when a predetermined time lapses from the electromagnetic valve 158 on the bypass loop 180 being open, the electromagnetic valve 158 is closed by the control device (not shown), then repeating the ordinary operation.

As described above, since the intermediate pressure refrigerant in the sealed container 12 can be escape to the evaporator 157 by using the bypass loop 180 (the aforementioned defrosting loop), the pressure inversion phenomenon between the high pressure and the intermediate pressure can be avoided without changing the pipe installation. Therefore, the manufacturing cost can be reduced.

Figure 10:
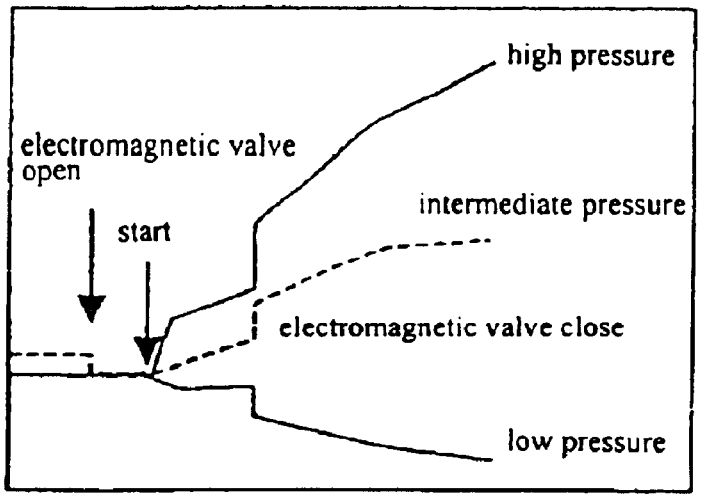
FIG. 10 shows a pressure behavior diagram corresponding to FIG. 9 of another embodiment of the present invention.

In the present embodiment, after the compressor starts, the electromagnetic valve 158 is open by the control device (not shown) when a predetermined time lapses, and the flow passage of the bypass loop 180 is open, but this is not to limit the scope of the invention. For example, as shown in FIG. 10, it can be also a situation that before the compressor 10 starts the electromagnetic valve 158 is open by the control device (not shown), and then closed after a predetermined time lapses. In addition, the electromagnetic valve 158 can be also open at the same time when the compressor 10 starts, and then closed after a predetermined time lapses. In these cases, the pressure inversion phenomenon between the intermediate pressure in the sealed container 12 and the high pressure at the discharging side of the second rotary compression element 34 can be also avoided.

In addition, in this embodiment, the compressor uses an internal intermediate pressure multi-stage (two stages) compression type rotary compressor, but this is not to limit the scope of the present invention. A multi-stage compression type compressor can be also used.

Eightth Embodiment

Figure 11:
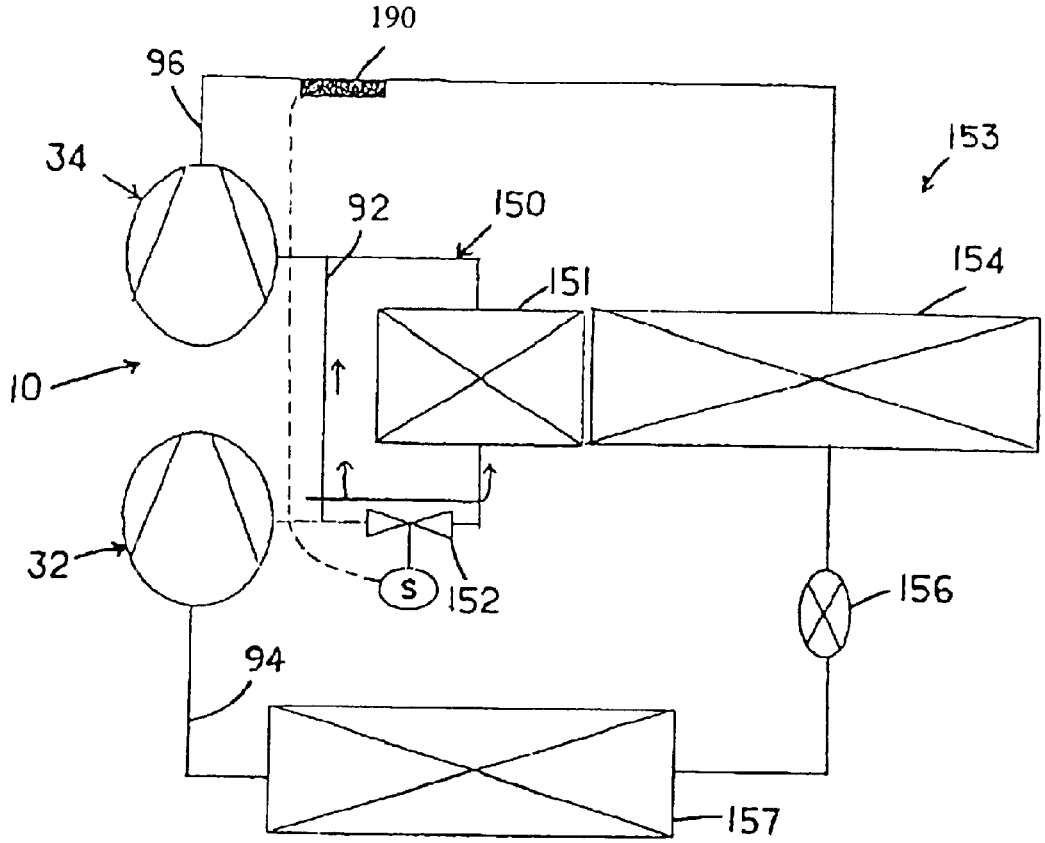
FIG. 11 is another refrigerant cycling loop according to a transcritical refrigerant cycling device of the present invention.

FIG. 11 shows the eighth embodiment of the present invention. In FIG. 11, the intermediate cooling loop 150 (not shown in FIG. 1) is connected to the refrigerant introduction pipe 92 in parallel. The intermediate cooling loop 150 is used to radiate heat of the intermediate pressure refrigerant gas, which is compressed by the first rotary compression element 32 and then discharged into the sealed container 12, by using the intermediate heat exchanger 151, and then absorb the refrigerant gas into the second rotary compression element 34. In addition, an electromagnetic valve 152 (as a valve device) is installed on the intermediate cooling loop 150 to control the refrigerant discharged from the first rotary compression element 31 to flow to the refrigerant introduction pipe 92 or to the intermediate cooling loop 150. According to the temperature of the refrigerant discharged from the second rotary compression element 34, which is detected by a temperature sensor 190 for the discharged gas, when the temperature of the discharged refrigerant is increased up to a predetermined value (e.g., 100° C.), the electromagnetic valve 152 is open, and the refrigerant flows into the intermediate cooling loop 150. When the temperature does not reach 100° C., the electromagnetic valve 152 is closed, and the refrigerant flows into the refrigerant introduction pipe 92. In addition, as described in this embodiment, the electromagnetic valve 152 is controlled to open and close at the same value (100° C.), but the upper limit value for opening the electromagnetic valve 152 and the lower limit value for closing the electromagnetic valve 152 can be set to different values. The aperture of the electromagnetic valve 152 can be adjusted linearly or in multi-stage according to a temperature variation.

The operation of the refrigerant cycling device according to the above configuration is described in detail. Furthermore, the electromagnetic valve 152 is closed by the temperature sensor 190 before the compressor 10 starts.

As the stator coil 28 of the electrical motor element 14 of the compressor 10 is electrified through the terminal 20 and the wires (not shown), the electrical motor element 14 starts so that rotor 24 starts rotating. By this rotation, the upper and the lower roller 46, 48, which are embedded to the upper and the lower eccentric parts 42, 44 that are integrally disposed with the rotational shaft 16, rotate eccentrically within the upper and the lower cylinders 38, 40.

In this way, the low pressure refrigerant gas, which passes through the absorption passage 60 formed in the refrigerant introduction pipe 94 and the lower supporting member 56 and is absorbed from the absorption port into the low pressure chamber of the lower cylinder 40, is compressed due to the operation of the roller 48 and the valve 52, and then becomes intermediate pressure status. Thereafter, starting from the high-pressure chamber of the lower cylinder 40, the intermediate pressure refrigerant gas passes through a connection passage (not shown), and then discharges from the intermediate discharging pipe 121 into the sealed container 12. Accordingly, the interior space of the sealed container 12 becomes the intermediate pressure status.

As described above, since the electromagnetic valve 152 is closed, the intermediate pressure refrigerant gas in the sealed container 12 flows to the refrigerant introduction pipe 92. Passing through an absorption passage (not shown) formed in the upper supporting member 54 from the refrigerant introduction pipe 92, the refrigerant is absorbed from the absorption port (not shown) to the low chamber of the upper cylinder 38 of the second rotary compression element 34. A two-stage compression is performed due to the operation of the roller 46 and the valve 50, so that the intermediate pressure refrigerant gas becomes a high pressure and temperature refrigerant gas. Then, from the high pressure chamber, the high pressure and temperature refrigerant gas goes to a discharging port (not shown), passes through the discharging muffler 62 formed in the upper supporting member 54, and discharges to the external via the refrigerant discharging pipe 96.

The high pressure and temperature refrigerant gas radiates heat at the gas cooler 15 to heat water in a water tank (not shown) to generate warm water. Furthermore, the refrigerant itself is cooled at the gas cooler 154 and then flows out of the gas cooler 154. After the cooled refrigerant is depressurized by the expansion valve 156, the depressurized refrigerant flows to the evaporator 157 and evaporates. At this time, heat is absorbed from the environment. Then, the refrigerant is absorbed to the first rotary compression element 32 via the refrigerant introduction pipe 94. This refrigerant cycle is repeated.

In addition, When a predetermined time lapses and the temperature of the refrigerant (discharged from the second rotary compression element 34) detected by the gas temperature sensor 190 is increased up to 100° C., the electromagnetic valve 152 is open by the temperature sensor 190 to open the intermediate cooling loop 150. In this way, the intermediate pressure refrigerant, which is compressed and discharged by the first rotary compression element 32, flows into the intermediate cooling loop 150, at which the refrigerant is cooled by the intermediate heat exchanger 151 and absorbed back to the second rotary compression element 34.

Figure 12:
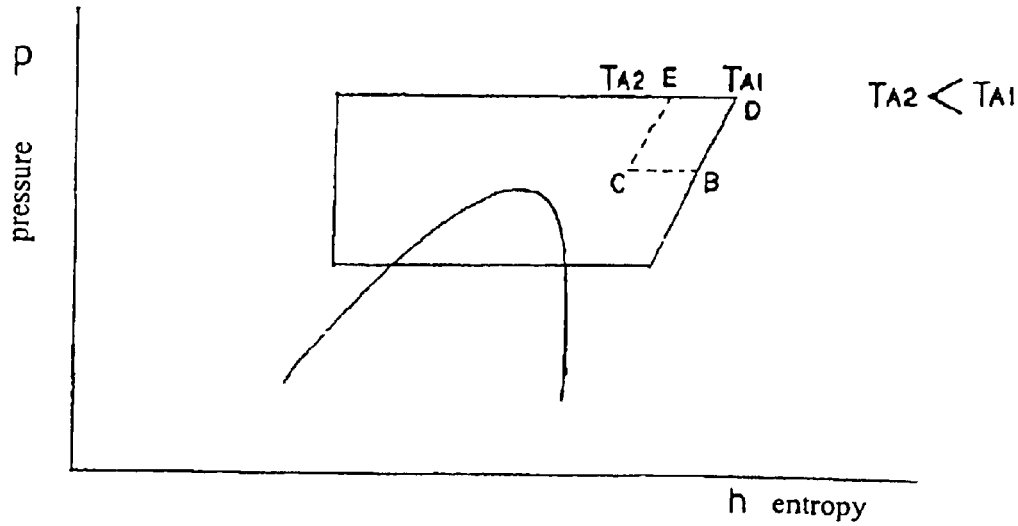
FIG. 12 shows a p-h diagram for a refrigerant cycling loop when the temperature of the discharged refrigerant from the second rotary compression element exceeds a predetermined value.

The aforementioned situation is described by referring to a p-h diagram (Mollier diagram) in FIG. 12. When the temperature of the refrigerant discharged from the second rotary compression element 34 is increased up to 100° C., the refrigerant compressed by the first rotary compression element 32 to becomes intermediate pressure status passes to the intermediate cooling loop 150 where heat is taken by the intermediate heat exchanger 151 that is arranged on the intermediate cooling loop 150 (status C represented by dash line in FIG. 12), and then the refrigerant is absorbed to the second rotary compression element 34. Then, the refrigerant is compressed by the second rotary compression element 34 and discharged to the external of the compressor 10 (status E in FIG. 12). In this situation, the temperature of the refrigerant that is compressed by the second rotary compression element 34 and discharged to the external of the compressor 10 becomes TA2 shown in FIG. 12.

When the temperature of the refrigerant discharged from the second rotary compression element 34 is increased up to 100° C. and the refrigerant does not flow in the intermediate cooling loop 150, the refrigerant that is compressed by the first rotary compression element 32 to become intermediate pressure status (status B in FIG. 12) passes through the refrigerant introduction pipe 92 and then is absorbed into the second rotary compression element 34, at which the refrigerant is compressed by the second rotary compression element 34 and then discharged to the external of the compressor 10 (status D in FIG. 12). In this situation, the temperature of the refrigerant that is compressed by the second rotary compression element 34 and discharged to the external of the compressor 10 becomes TA1 shown in FIG. 12. The temperature is higher than the case that the refrigerant flows to the intermediate cooling loop 150. Therefore, since the temperature in the compressor 10 increases and the compressor 10 is overheated, the loading is increased and the operation of the compressor 10 becomes unstable. Due to the high temperature environment in the sealed container 12, the oil is degraded that might cause an adverse influence to the durability of the compressor 10. However, according to the embodiment as described above, the refrigerant is made to pass through the intermediate cooling loop 150. The refrigerant compressed by the first rotary compression element 32 is cooled by the intermediate heat exchanger 151. Then, the refrigerant is absorbed into the second rotary compression element 34. In this manner, a temperature rising of the refrigerant cooled and discharged by the second rotary compression element 34 can be prevented.

Accordingly, disadvantages of an abnormal temperature rising of the refrigerant compressed and discharged by the second rotary compression element 34 and an adverse influence to the refrigerant cycling device can be avoided.

As the temperature of the refrigerant discharged from the second rotary compression element 34, which is detected by the gas temperature sensor 190, is decreased lower than 100° C., the electromagnetic valve 152 is closed by the gas temperature sensor 190 to repeat the normal operation.

In this way, because the refrigerant compressed by the first rotary compression element 32 will be absorbed into the second rotary compression element 34 without passing through the intermediate cooling loop 150, the refrigerant temperature is almost not decreased during the process that the refrigerant is absorbed into the second rotary compression element 34. Therefore, the temperature of the refrigerant gas will not be decreased too much, so that a disadvantage of preparing high temperature water at the gas cooler 154 can be avoided.

As described above, the refrigerant introduction pipe 92 for absorbing the refrigerant compressed by the first rotary compression element 32 into the second rotary compression element 34; the intermediate cooling loop 150 connected to the refrigerant introduction pipe 92 in parallel; and the electromagnetic valve 152 for controlling the refrigerant discharged from the first rotary compression element 32 to flow to the refrigerant introduction pipe 92 or the intermediate cooling loop 150 are equipped. When the temperature of the refrigerant discharged from the second rotary compression element 34 is detected by the gas temperature sensor 190 and the detected temperature is increased up to 100° C., the electromagnetic valve 152 is open so that the refrigerant flows to the intermediate cooling loop 150. Therefore, the present invention can prevent a disadvantage that the temperature of the refrigerant discharged from the second rotary compression element 34 is abnormally increased to cause that the compressor 10 is overheated and its operation behavior becomes unstable. In addition, the present invention can also prevent a disadvantage that due to the high temperature environment in the sealed container 12 the oil is degraded to bring an adverse influence on the durability of the compressor 10. Accordingly, the durability of the compressor 10 can be increased and improved.

In addition, when the gas temperature sensor 190 detects that the temperature of the refrigerant discharged from the second rotary compression element 31 is decreased lower than 100° C., the electromagnetic valve 152 is closed. The refrigerant compressed by the first rotary compression element 32 goes to the refrigerant introduction pipe 92, and is absorbed into the second rotary compression element 34. As a result, the temperature of the refrigerant compressed and discharged by the second rotary compression element 34 can be a high temperature.

In this way, the temperature of the refrigerant at starting the compressor can be increased easily, and the refrigerant absorbed into the compressor 10 can return to a normal status early. Therefore, the start ability of the compressor 10 can be improved.

As a result, because the high temperature refrigerant of about 100° C. usually flows to the gas cooler 154, hot water with a predetermined temperature can be always made at the gas cooler 154. In this way, the reliability of the refrigerant cycling device can be increased;

In addition, on the pipe between the compressor 10 and the gas cooler 154, the electromagnetic valve is controlled by detecting the temperature of the refrigerant discharged from the second rotary compression element 34 of the compressor 10 with the gas temperature sensor 190, but this is not to limit the scope of the present invention. For example, the electromagnetic valve 152 can be also controlled with time. In this case, the electromagnetic valve 152 is controlled so that the refrigerant flows to the refrigerant introduction pipe 92 within a predetermined time interval from starting the compressor 10 to increase the temperature of the discharged refrigerant, and then flows to the intermediate cooling loop 150.

Furthermore, in this embodiment, the compressor uses an internal intermediate pressure type multi-stage (two stages) compression rotary compressor, but this is not to limit the scope of the present invention. A multi-stage compression type compressor can be also used.

Ninth Embodiment

Figure 13:
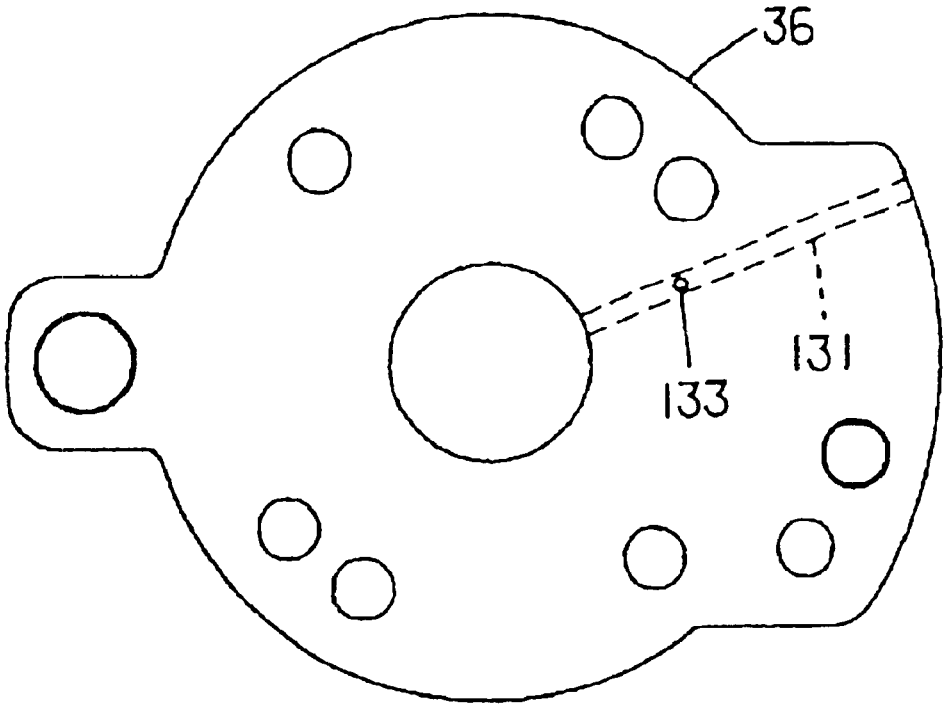
FIG. 13 is a plane view of the intermediate partition plate in the compressor shown in FIG. 1.
Figure 14:
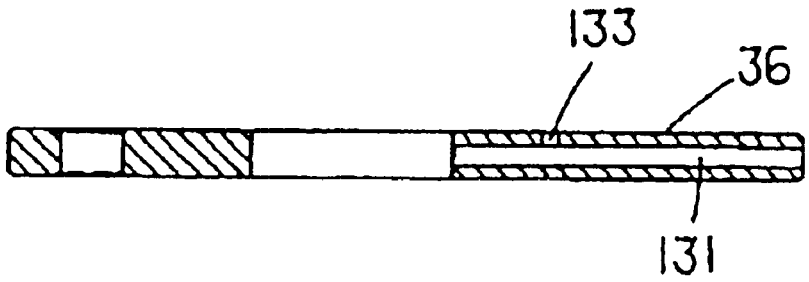
FIG. 14 is a vertical cross-sectional view of the intermediate partition plate in the compressor shown in FIG. 1.
Figure 15:
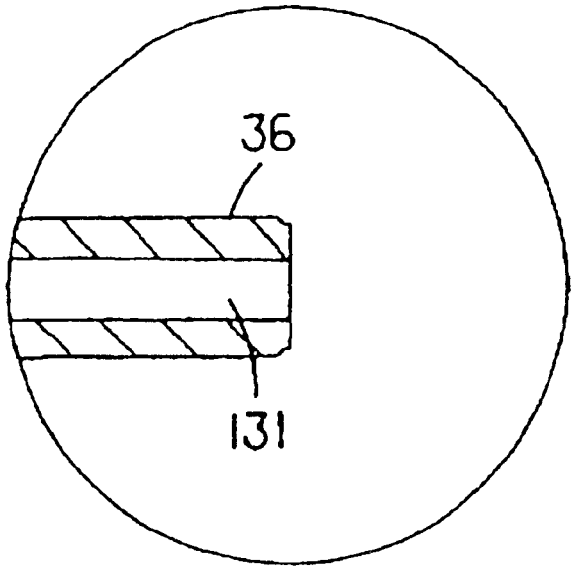
FIG. 15 is an enlarged diagram at the sealed container side of the penetration hole that is formed in the intermediate partition plate in the compressor in FIG. 1.

The ninth embodiment relates to a structure of the intermediate partition plate 36 of the compressor 10 in FIG. 1. As shown in FIGS. 13 to 15, a penetration hole 131 for connecting the interior of the sealed container 12 and the inner side of the roller 46 is formed by penetrating the intermediate partition plate 36 by a capillary working process. FIG. 13 is plane view of the intermediate partition plate 36, FIG. 14 is a vertical cross-sectional view of the intermediate partition plate 36, and FIG. 15 is an enlarged diagram of the penetration hole 131 at the sealed container 12 side. A certain gap is formed between the intermediate partition plate 36 and the rotational shaft 16. In the gap between the intermediate partition plate 36 and the rotational shaft 16, the upper side is connected to the inner side of the roller 46 (peripheral space of the eccentric part 42 at the inner side of the roller 46), and the lower side is connected to the inner side of the roller 48. The penetration hole 131 is a passage that the high pressure refrigerant gas can escape to the sealed container 12, wherein high pressure refrigerant gas leaks from gap, formed between the upper supporting member 54 that blocks the upper opening of the cylinder 38 and the roller 46 in the cylinder 38 and the intermediate partition plate 36 that blocks the lower opening, to the inner side of the roller 46 (peripheral space of the eccentric part 42 at the inner side of the roller 46). Then, the high pressure refrigerant gas, which flows to the gap between the intermediate partition plate 36 and the rotational shaft 16 and to the inner side of the roller 48, escapes to the inside of the sealed container 12.

The high pressure refrigerant leaking to the inner side of the roller 46 arrives the gap formed between the intermediate partition plate 36 and the rotational shaft 16, and then enters the penetration hole 131. The refrigerant thus flows into the sealed container 12.

In this manner, since the high pressure refrigerant gas leaking to the inner side of the roller 46 can escape from the penetration hole 131 to the sealed container 12, a disadvantage that the high pressure refrigerant gas accumulates at the inner side of the roller 46, the gap between the intermediate partition plate 36 and the rotational shaft 16 and the inner side of the roller 48 can be avoided. Therefore, by using a pressure difference caused by the oil supplying holes 82, 84 of the aforementioned rotational shaft 16, the oil can be supplied to the inner side of the roller 46 and the inner side of the roller 48.

In particular, only by forming the penetration hole 131 that penetrates through the intermediate partition plate 36 in the horizontal direction, the high pressure leaking to the inner side of the roller 46 can escape to the interior of the sealed container 12. An increase in processing cost can be extremely suppressed.

Furthermore, a connection hole (a vertical hole) 133 is pierced at the upper side in the midway of the penetration hole 131. A connection hole 134 for injection is pierced on in the upper cylinder 38 for connecting the absorption port (the absorption side of the second rotary compression element 34) 161 and the connection hole 133 of the intermediate partition plate 36. An opening of the penetration hole 131 of the intermediate partition 36 at the rotational shaft 16 side is connected to an oil hole (not shown) through the aforementioned oil supplying holes 82, 84.

In this case, as will be described in the following paragraphs, because the pressure in the sealed container 12 is an intermediate pressure, it is very difficult to supply oil to the upper cylinder 38 that is the second stage with a high pressure. However, because of forming the structure of the intermediate partition plate 36, the oil enters the penetration hole 131 of the intermediate partition plate 36, passes through the connection holes 133, 134, and then is supplied to the absorption side (the absorption port 161) of the upper cylinder 38, wherein the oil is drained from the oil accumulator at the bottom of the sealed container 12, lifted through the oil hole (not shown) and then out of the oil supplying holes 82, 84.

Figure 16:
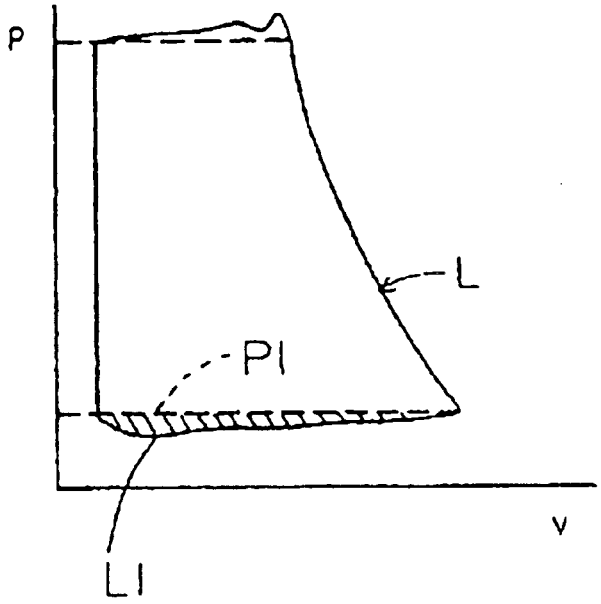
FIG. 16 shows a pressure variation diagram at the absorption side of the upper cylinder of the compressor in FIG. 1.

Referring to FIG. 16, L represents a pressure variation in the upper cylinder 38 at the absorption side, and P1 is the pressure of the intermediate partition plate 36 at the rotary shaft 16 side. In FIG. 16, as indicated by L1, the pressure of the upper cylinder 38 at the absorption side (the absorption pressure) is lower than the pressure of the intermediate partition plate 36 at the rotational shaft 16 side because of a absorption pressure loss during the absorption process. In this period, the oil passes the oil hole (not shown) of the rotary shaft 16, and passes through the penetration hole 131, the connection hole 133 of the intermediate partition plate 36 from the oil supplying holes 82, 84. Then, the oil is injected from the connection hole 134 of the upper cylinder 38 to the upper cylinder 38 to supply the oil.

As described, by forming the connection hole (the vertical hole) 133 that extends at the upper side in the penetration hole 131 formed for the high pressure refrigerant leaking to the inside of the roller 46 to escape to the sealed container 12 and forming the connection hole 131 for injection that connects the absorption port 161 of the upper cylinder 38 and the penetration hole 133 of the intermediate partition plate 36, even though the pressure of the cylinder 38 of the second rotary compression element 34 is higher that the intermediate pressure in the sealed container 12, the oil can be sill actually supplied from the penetration hole 131 formed in the intermediate partition plate 36 to the upper cylinder 38 by using the absorption pressure loss during the absorption process.

Supplying the oil to the second rotary compression element 34 can be actually performed by only forming the connection hole 133 and the connection hole 134 in the cylinder 38, wherein the connection hole 133 also serving as the penetration hole 131 for releasing the high pressure at the inner side of the roller 46 extends to the upper side from the penetration hole 131, and the connection hole 134 connects the connection hole 133 and the absorption port 161 of the upper cylinder 38. Therefore, the performance and reliability of the compressor can be achieved with a simple structure and low cost.

Accordingly, a disadvantage of a high pressure at the inner side of the roller 46 of the second rotary compression element 34 can be avoided. Additionally, lubrication for the second rotary compression element 34 can well performed. For the compressor, the performance can be maintained and its reliability can be improved.

As described above, the rotational number is controlled in a manner the electric motor element 14 is started with a low speed by an inverter when the compressor starts. Therefore, from the penetration hole 131, even though the oil is drained from the oil accumulator at the bottom of the sealed container 12 when the rotary compressor 10 starts, an adverse influence caused by a liquid compression can be suppressed and the reliability reduction can be prevented.

In this case, considering the environment protection issue, the combustibility and the toxicity, the refrigerant uses a nature refrigerant, i.e., the aforementioned carbon dioxide ($CO_2$). The oil, used as a lubricant oil sealed in the sealed container 12, can use existed oil, for example, a mineral oil, an alkyl benzene oil, an ether oil, and a PAG (poly alkyl glycol).

In addition, the sleeves 141, 142, 143 and 144 are fused to fix on the side faces of the main body 12A of the sealed container 12 at positions corresponding to the absorption passages 58, 60 of the upper supporting member 54 and the lower supporting member 56 and the upper sides of the discharging muffler chamber 62 and the upper cover 66 (positions substantially corresponding to the lower end of the electric motor element 14). The sleeves 141 and 142 are vertically adjacent to each other, and the sleeve 143 is substantially located on a diagonal line of the sleeve 141. The sleeve 144 is located at a position slightly deviated from the sleeve 141 by 90°.

One end of the refrigerant introduction pipe 92 for introducing the refrigerant gas to the upper cylinder 38 is inserted into the sleeve 141, and that end of the refrigerant introduction pipe 92 is connected to the absorption passage 58 of the upper cylinder 38. The refrigerant introduction pipe 92 passes the upper side of the sealed container 12 and then reaches the sleeve 144. The other end is inserted into the sleeve 144 to connect to the sealed container 12.

In addition, one end of the refrigerant introduction pipe 94 for introducing the refrigerant gas to the lower cylinder 40 is connected to insert into the sleeve 142, and that end of the refrigerant introduction pipe 94 is connected to the absorption passage 60 of the lower cylinder 40. In addition, the refrigerant discharging pipe 96 is connected to inserted into the sleeve 143, and that end of the refrigerant discharging pipe 96 is connected to the discharging muffler chamber 62.

The operation with the aforementioned structure is described in detail as follow. Before the rotary compressor 10 starts, the oil surface level in the sealed container 12 is usually higher than the opening (the sealed container 12 side) of the penetration hole 131 formed in the intermediate partition plate 36. Therefore, the oil in the sealed container 12 flows into the penetration hole 131 from the opening of the penetration hole 131 at the container 12 side.

As the stator coil 28 of the electrical motor element 14 is electrified through the wires (not shown) and the terminal 20, the electrical motor element 14 starts so as to rotate the rotor 24. By this rotation, the upper and the lower roller 46, 48, which are embedded to the upper and the lower eccentric parts 42, 44 that are integrally disposed with the rotational shaft 16, rotate eccentrically within the upper and the lower cylinders 38, 40.

In this way, the low pressure refrigerant gas (4MPaG), which passes through the absorption passage 60 formed in the refrigerant introduction pipe 94 and the lower supporting member 56 and is absorbed from the absorption port 62 into the low pressure chamber of the lower cylinder 40, is compressed due to the operation of the roller 48 and the valve 52, and then becomes intermediate pressure status (8MPaG). Thereafter, starting from the high-pressure chamber of the lower cylinder 40, the intermediate pressure refrigerant gas passes through a connection passage (not shown), and then discharges from the intermediate discharging pipe 121 into the sealed container 12.

The intermediate pressure refrigerant gas in the sealed container 12 comes out of the sleeve 144, passes through the absorption passage 58 formed in the refrigerant introduction pipe 92 and the upper supporting member 54, and then is absorbed into the low pressure chamber of the upper cylinder 38 from the absorption port 161.

As the compressor 10 starts, the oil intruding from the opening of the penetration hole 131 at the sealed container 12 side passes to the connection hole 131, and then is absorbed into the low pressure chamber of the upper cylinder 38 of the second rotary compression element 34. The intermediate pressure refrigerant gas absorbed into the low pressure chamber of the upper cylinder 38 and the oil are compressed by the operation of the roller 46 and the valve (not shown) by two stages. At this time, the refrigerant becomes high temperature and high pressure (12MPaG).

In this situation, the intermediate pressure refrigerant and the oil intruding from the opening of the penetration hole 131 at the sealed container 12 side are compressed. Since the rotational number is controlled in a manner that the compressor 10 is operated with a low speed by an inverter when the compressor 10 starts, the torque is small. Therefore, even though the oil is compressed, there is almost no influence on the compressor 10 and the compressor 10 can be normally operated.

Then, the rotational number is increased by a predetermined control pattern, and finally, the electric motor element 14 is operated at a desired rotational number. During the operation, the oil surface level is lower than the lower side of the penetration hole 131. However, passing through the connection hole 133 and the connection hole 134 from the penetration hole 131, the oil is supplied to the absorption side of the second rotary compression element 34. Therefore, an insufficient oil supply for the sliding part of the second rotary compression element 34 can be avoided.

As described, the penetration hole 131 that connects the interior of the sealed container 12 and the inner side of the roller 46 is pierced in the intermediate partition plate 36, and the connection holes 133, 134 for connecting the penetration hole 131 of the intermediate partition plate 36 and the absorption side of the second rotary compression element 34 are pierced in the cylinder 38 of the second rotary compression element 34. Accordingly, the high pressure refrigerant gas leaking to the inner side of the roller 46 can be released from the penetration hole 131 to the sealed container 36.

In this way, because the oil for lubrication is supplied from the oil supplying holes 82, 84 of the rotational shaft 16 by using the pressure difference between the inner side of the roller 46 and the inner side of the roller 48, an insufficient oil supply at the peripheral of the eccentric part 42 of the inner side of the roller 46 and at the peripheral of the eccentric part 44 of the inner side of the roller 48 can be avoided.

In addition, even though the pressure in the upper cylinder 38 of the second rotary compression element 34 is higher than the intermediate pressure in the sealed container 12, the oil can be firmly supplied to the upper cylinder 38 from the connection holes 133, 134 formed for connecting with the penetration hole 131 of the intermediate partition plate 36 by using an absorption pressure loss during the absorption process of the second rotary compression element 34.

Furthermore, a disadvantage that the inner side of the roller 46 becomes high pressure can be avoided by a simpler structure and the lubrication for the second rotary compression element 34 can be actually performed. Therefore, the performance of the compressor 10 can be maintained and the reliability of the compressor 10 can be also improved.

In addition, because the electric motor element 14 is a motor of rotational number controllable type that the electric motor element 14 is started with a low speed at starting, even though the oil is absorbed from the oil accumulator at the bottom of the sealed container 12 from the penetration hole 131 when the compressor 10 starts, a adverse influence caused by a liquid compression can be suppressed and a reliability reduction can be avoided.

In addition, in the present embodiment, the upper side of the gap formed between the intermediate partition plate 36 and the rotational shaft 16 is connected to the inner side of the roller 46 and the lower side of the gap is connected to the inner side of the roller 48, but that is not used to limit the scope of the present invention. For example, it can be a situation that only the upper side of the gap formed between the intermediate partition plate 36 and the rotational shaft 16 is connected to the inner side of the roller 46 (but the lower side of the gap is not connected to the inner side of the roller 48). Alternatively, the inner side of the roller 46 and the inner side of the roller 48 can be partitioned by the intermediate partition plate 36. In this case, by forming a hole along the axial direction in the midway of the penetration hole 131 of the intermediate partition plate 36 for connecting the inner side of the roller 46, the high pressure at the inner side of the roller 46 can be released into the sealed container 12. Furthermore, the oil can be supplied from the oil supplying hole 82 to the absorption side of the second rotary compression element 32.

In addition, according to the embodiment, in the compressor the capacity of the first rotary compression element is 2.89 c.c. and the capacity of the second rotary compression element is 1.88 c.c., but these capacities are not used to limit the scope of the present invention. A compressor with other capacities can be also used.

Moreover, according to the present embodiment, a two-stage rotary compressor having the first and the second rotary compression elements is used to describe, but that is not to limit the scope of the present invention. A multi-stage rotary compressor having three, four or more rotary compression elements can be also used.

Tenth Embodiment

Figure 17:
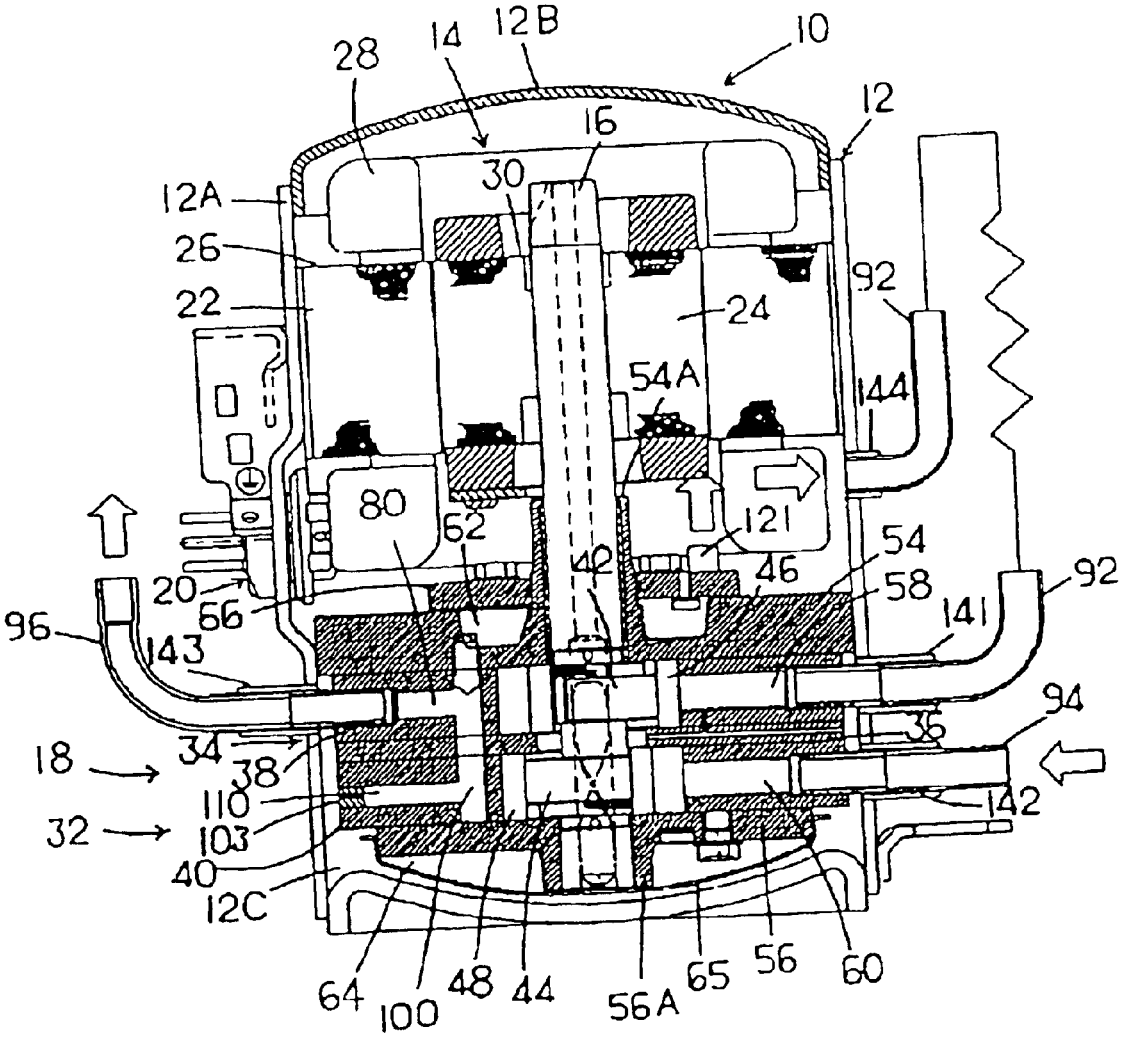
FIG. 17 is a vertical cross-sectional view of an internal intermediate pressure multi-stage compression type rotary compressor according to one embodiment of the present invention.
Figure 18:
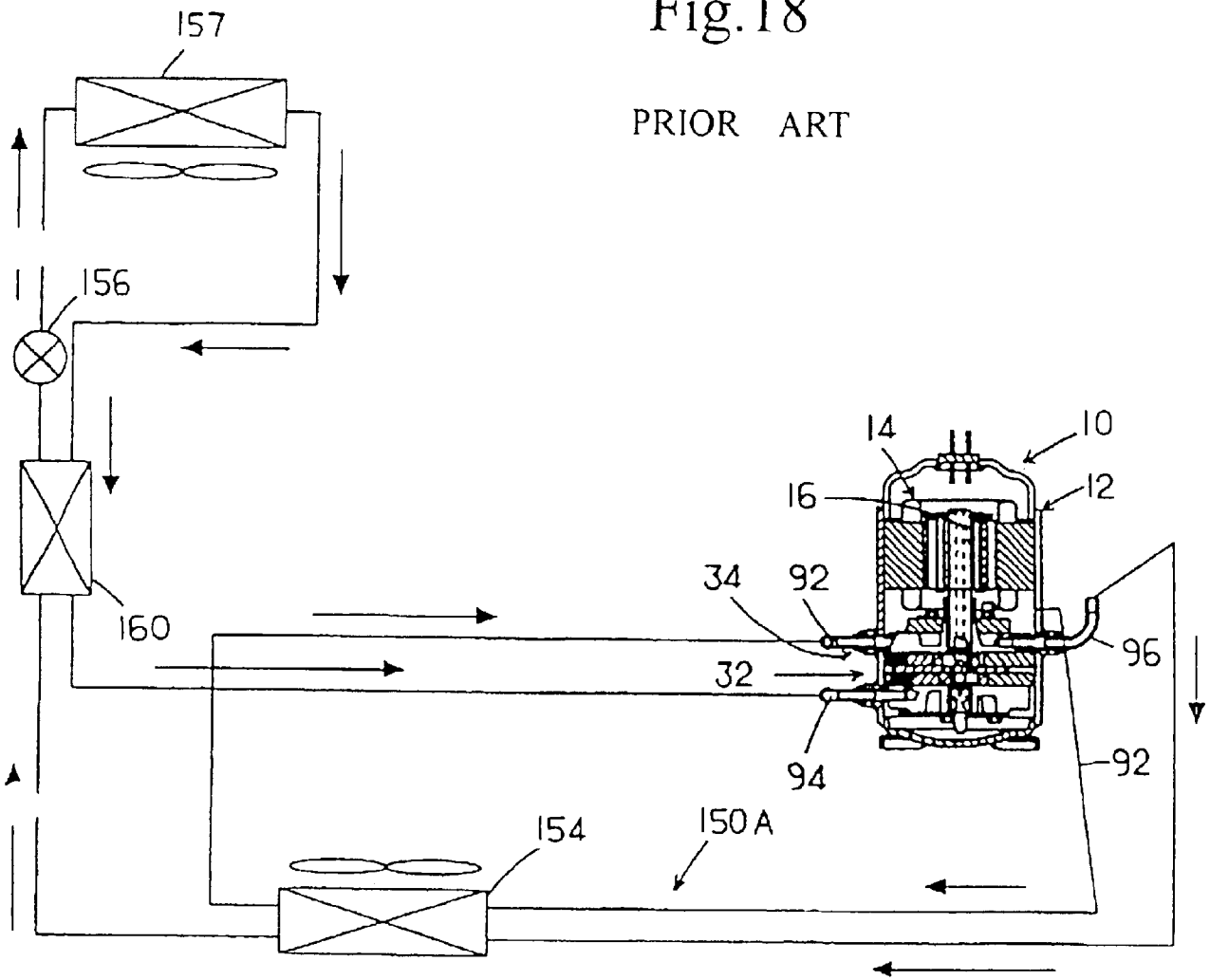
Fig.18 PRIOR ART
FIG. 18 is a refrigerant cycling loop of a conventional transcritical refrigerant cycling device.
Figure 19:
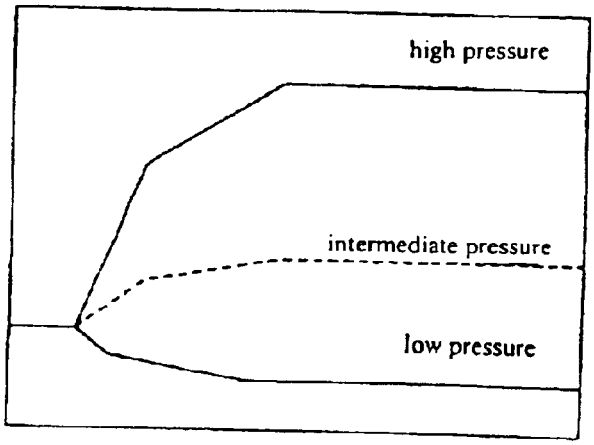
Fig.19 PRIOR ART
FIG. 19 shows a pressure behavior diagram when the compressor of the refrigerant cycling device starts normally in the conventional refrigerant cycling device.
Figure 20:
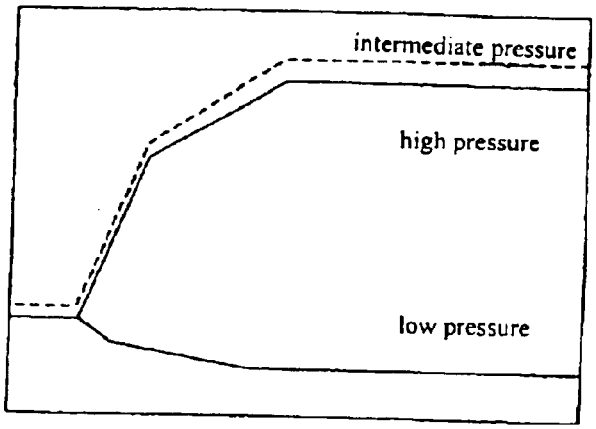
Fig.20 PRIOR ART
FIG. 20 is a pressure behavior diagram when a pressure inversion phenomenon occurs in the conventional refrigerant cycling device.
Figure 21:
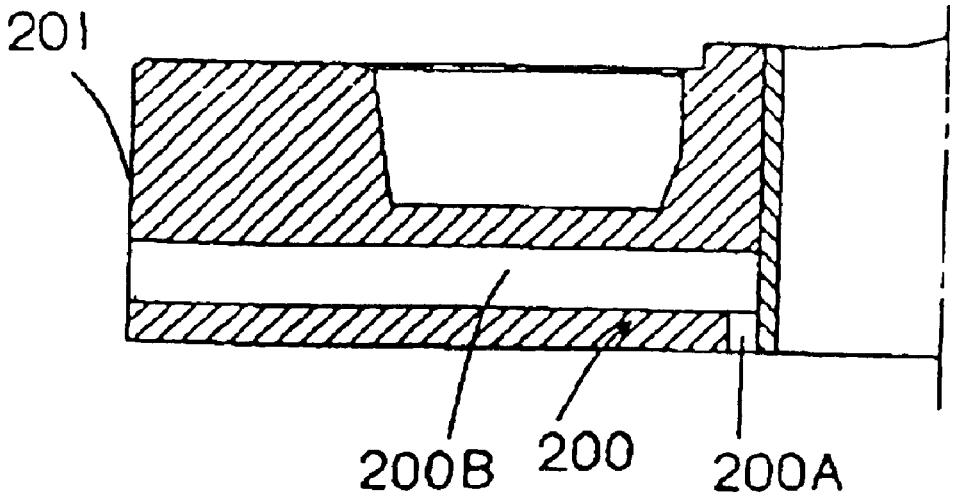
Fig. 21 PRIOR ART
FIG. 21 is a vertical cross-sectional view of an upper supporting member of a conventional rotary compressor.

Next, the tenth embodiment of the present invention is described in detail as follows. FIG. 17 shows a vertical cross-sectional view of an internal intermediate pressure multi-stage (e.g., two stages) compression type rotary compressor 10 according to the tenth embodiment of the present invention. In FIG. 17, numerals as the same as those in FIG. 1 are labeled with the same numbers, and have the same or similar functions of effects.

Referring to FIG. 17, absorption passages 58, 60 for connecting to the interiors of the upper and lower cylinders 38, 40 respectively are formed in the absorption ports (not shown). In addition, a discharging muffler chamber 62 for discharging the refrigerant compressed in the upper cylinder 38 from a discharging port (not shown) is formed in the upper supporting member 54, wherein the discharging muffler chamber is formed by covering a recess part of the upper supporting member 54 by using a cover that servers as a wall. Namely, the discharging muffler chamber 62 is blocked by the upper cover 66 serving as a wall to form the discharging muffler chamber 62.

In addition, the refrigerant gas compressed in the lower cylinder 40 is discharged from the discharging port (not shown) to the discharging muffler chamber 64 formed at a position opposite to the electric motor element 14 (the bottom side of the sealed container 12). The discharging muffler chamber 64 is constructed by a cup 65 for covering a portion of the lower supporting member 56 that is opposite to the electric motor element 14. The cup 65 has a hole for the rotational shaft 16 and a bearing 56A of the lower supporting member 56 to penetrated through the center, wherein the lower supporting member 56 also used as the bearing of and the rotational shaft 16.

In this case, the bearing 54A is formed by standing on the center of the upper supporting member 54. The aforementioned bearing 56A is formed by penetrating through the center of the lower supporting member 56. Therefore, the rotational shaft 16 is held by the bearing 54A of the lower supporting member 54 and the bearing 56A of the upper supporting member element 56.

The discharging muffler chamber 64 of the first rotary compression element 32 and the interior of the sealed container 12 is connected by a connection passage. The connection passage is the lower supporting member 56, the upper supporting member 54, the upper cover 66, the upper cylinder 38, the lower cylinder 40 and a hole (not shown) penetrating through the intermediate partition plate 36. In this case, an intermediate discharging pipe 121 is formed by standing on the upper end of the connection passage, and the intermediate pressure refrigerant in the sealed container 12 is discharged from the intermediate discharging pipe 121.

In addition, the upper cover 66 divides to form the interior of the upper cylinder 38 of the second rotary compression element 34 and the discharging muffler chamber 62 that connects to the discharging port. The electric motor element 14 is arranged on the upper side of the upper cover 66 with a predetermined gap from the upper cover 66. The upper cover 66 is formed by a circular steel plate with a substantially doughnut shape and has a hole formed thereon, wherein a bearing 54A of the upper supporting member 54 penetrates through that hole.

The oil, used as a lubricant oil sealed in the sealed container 12, can use existed oil, for example, a mineral oil, an alkyl benzene oil, an ether oil, and a PAG (poly alkyl glycol).

In addition, the sleeves 141, 142, 143 and 144 are fused to fix on the side faces of the main body 12A of the sealed container 12 at positions corresponding to the absorption passages 58, 60 of the upper and lower cylinders 38, 40, the absorption passage of the upper cylinder 38, and the lower side of the rotor 27 (directly below the electric motor element 14). The sleeves 141 and 142 are vertically adjacent to each other, and the sleeve 143 is substantially located on a diagonal line of the sleeve 141. In addition, the sleeve 144 is located above the sleeve 141.

One end of the refrigerant introduction pipe 92 for introducing the refrigerant gas to the upper cylinder 38 is inserted into the sleeve 141, and that end of the refrigerant introduction pipe 92 is connected to the absorption passage 58 of the upper cylinder 38. The refrigerant introduction pipe 92 passes the upper side of the sealed container 12 and then reaches the sleeve 144. The other end is inserted into the sleeve 144 to connect to the sealed container 12.

In addition, one end of the refrigerant introduction pipe 94 for introducing the refrigerant gas to the lower cylinder 40 is connected to insert into the sleeve 142, and that end of the refrigerant introduction pipe 94 is connected to the absorption passage 60 of the lower cylinder 40. In addition, the refrigerant discharging pipe 96 is connected to inserted into the sleeve 143, and that end of the refrigerant discharging pipe 96 is connected to a discharging passage 80 that will be described below.

The aforementioned discharging passage 80 is a passage connecting the discharging muffler chamber 62 and the refrigerant discharging pipe 96. The discharging passage 80 is branched from the midway of an oil accumulator 100 (that will be described below) and formed in the upper cylinder 38 along the horizontal direction. One end of the aforementioned refrigerant discharging pipe 96 is connected to insert to the discharging passage 80.

The refrigerant, which is compressed by the second rotary compression element 34 and is discharged into the discharging muffler chamber 62, passes through the discharging passage 80, and then is discharged from the refrigerant discharging pipe 96 to the exterior of the compressor 10.

In addition, the aforementioned oil accumulator 100 is formed in the lower cylinder 40 and is located at a position opposite to the absorption passage 60 of the second rotary compression element 34. The oil accumulator 100 is constructed by a hole that penetrates the upper cylinder 38, the intermediate partition plate 36 and the lower cylinder 40 in an up-and-down direction. The upper end of the oil accumulator 100 is connected to the discharging muffler chamber 62 and blocked by the lower supporting member 56. The discharging passage 80 is connected to a position that is slightly lower than the upper end of the oil accumulator 100.

In addition, a return passage 110 is formed by branching form a position that is slightly higher than the lower end of the oil accumulator 100. The return passage 110 is a hole that is formed in the lower cylinder 40 along the horizontal direction from the oil accumulator 100 to the outer side (the sealed container 12 side). A throttling member 103 formed in a tiny hole for a throttling function is formed in the return passage 110. In this way, the return passage 110 is connected to the sealed container 12 and the oil accumulator 100 through the throttling member 103. Therefore, the oil accumulated at the bottom of the oil accumulator 100 passes through the tiny hole of the throttling member 103 in the return passage 110, and then is depressurized to flow into the sealed container 12. The flowed-out oil returns to the oil accumulator 12C located at the bottom of the sealed container 12.

By forming the oil accumulator 100 in a rotary compression mechanism 18, after the refrigerant gas and oil that are discharged and compressed by the second rotary compression element 34 are discharged from the discharging muffler chamber 62, the refrigerant gas and the oil flow into the oil accumulator 100. Then, the refrigerant moves to the discharging passage 80, while the oil flows downwards to a lower part of the oil accumulator 100. In this way, since the oil discharged together with the refrigerant from the second rotary compression element 34 is smoothly separated from the refrigerant gas and accumulated at the lower part of the oil accumulator 100, an oil amount discharged to the exterior of the compressor 10 can be reduced. Therefore, a disadvantage that the oil flows to the refrigerant cycling loop with a large amount to degrade the refrigerant cycling performance can be extremely avoided.

In addition, the oil that stays the oil accumulator 100 returns through the return passage 100 having the throttling member 103 to the oil accumulator 12C formed at the bottom of the sealed container 12. Therefore, a disadvantage of insufficient oil in the sealed container 12 can be avoided.

In summary, the oil discharging to the refrigerant cycling loop can be extremely avoided and the oil can be smoothly supplied to the sealed container 12. Accordingly, the performance and the reliability of the compressor 10 can be thus improved and increased.

Furthermore, because the oil accumulator 100 is formed by a penetration hole that penetrates the intermediate partition plate 36 and the lower cylinder 40, the oil discharging to the exterior of the compressor 10 can be extremely reduced by a very simple structure.

Furthermore, because the oil accumulator 100 is formed in the lower cylinder 40 at a position opposite to the absorption passage 60 of the lower cylinder 40, the space utilizing efficiency can be increased.

The operation with the aforementioned structure is described in detail as follow. As the stator coil 28 of the electrical motor element 14 is electrified through the wires (not shown) and the terminal 20, the electrical motor element 14 starts so as to rotate the rotor 24. By this rotation, the upper and the lower roller 46, 48, which are embedded to the upper and the lower eccentric parts 42, 44 that are integrally disposed with the rotational shaft 16, rotate eccentrically within the upper and the lower cylinders 38, 40.

In this way, the low pressure refrigerant gas, which passes through the absorption passage 60 formed in the refrigerant introduction pipe 94 and the lower supporting member 56 and is absorbed from the absorption port 62 into the low pressure chamber of the lower cylinder 40, is compressed due to the operation of the roller 48 and the valve 52, and then becomes intermediate pressure status. Thereafter, starting from the high-pressure chamber of the lower cylinder 40, the intermediate pressure refrigerant gas passes through a connection passage (not shown), and then discharges from the intermediate discharging pipe 121 into the sealed container 12.

The intermediate pressure refrigerant gas in the sealed container 12 comes out of the sleeve 144, passes through the absorption passage 58 formed in the refrigerant introduction pipe 92 and the upper supporting member 54, and then is absorbed into the low pressure chamber of the upper cylinder 38 from the absorption port (not shown). The absorbed intermediate pressure refrigerant gas is compressed by the operation of the roller 46 and the valve (not shown) by the second stage compression to become a high temperature and high pressure refrigerant gas. The high temperature and high pressure refrigerant gas passes to the discharging port (not shown) from the high pressure chamber, and then is discharged to the discharging muffler chamber 62 formed in the upper supporting member 54.

The oil supplied to the second rotary compression element 34 is also mixed with the refrigerant gas compressed by the second rotary compression element 34, and the oil is also discharged to the discharging muffler chamber 62. Then, the refrigerant gas discharged to the discharging muffler chamber 62 and the oil mixed with that refrigerant gas reach the oil accumulator 100. After entering the oil accumulator 100, the refrigerant moves to the discharging passage 80, and the oil is separated and accumulated at the lower part of the oil accumulator 100 as described above. The oil accumulated at the oil accumulator 100 passes through the aforementioned return passage 110, and then flows into the throttling member 103. The oil flowing to the throttling member 103 is depressurized, and then flows to the sealed container 12. The flowed-out oil returns to the oil accumulator 12 at the bottom of the sealed container 12, enclosed by the wall of the container main body 12A of the sealed container 12, the lower cylinder 40 and the lower supporting member 56, etc. On the other hand, the refrigerant gas goes to the refrigerant discharging pipe 96 from the discharging passage 80, and the is discharged to the exterior of the compressor 10.

As described, the oil accumulator 100 for separating the oil that is discharged together with the refrigerant gas from the second rotary compression element 34 as well as for accumulating the oil is formed in the rotary compression mechanism 18, and the oil accumulator 100 is connected to the sealed container 12 through the return passage 110 with the throttling member 103. Therefore, the oil amount discharged to the exterior of the compressor 10 together with the refrigerant gas compressed by the second rotary compression element 34 can be reduced.

In this manner, a disadvantage that the oil flows to the refrigerant cycling loop with a large amount to degrade the refrigerant cycling performance can be extremely avoided.

Furthermore, because the oil accumulator 100 is formed in the lower cylinder 40 at a position opposite to the absorption passage 60 of the lower cylinder 40, the space utilizing efficiency can be increased.

Furthermore, because the oil accumulator 100 is formed by a penetration hole that penetrates the intermediate partition plate 36, the upper cylinder 38 and the lower cylinder 40, the oil discharging to the exterior of the compressor 10 can be extremely reduced by a very simple structure.

In this embodiment, the discharging passage of the second rotary compression element 34 is formed in the upper cylinder 38 and the refrigerant gas is discharged to the exterior through the discharging passage 80 and the refrigerant discharging pipe 96, but that is not used to limit the scope of the present invention. For example, the discharging passage 80 of the second rotary compression element 34 can be also formed in the upper supporting member 54, which can still achieve the effect of the present embodiment of the present invention.

In this case, the upper end of the oil accumulator 100 can be connected to the interior of the discharging muffler chamber 62, or connected to the midway of the discharging passage 80 out of the discharging muffler chamber 62.

In addition, according to the present embodiment, the return passage 110 is a structure formed in the lower cylinder, but that is not to limit the scope of the present invention. For example, the return passage 110 can be also formed in the lower supporting member 56.

Moreover, according to the present embodiment, a two-stage rotary compressor having the first and the second rotary compression elements is used to describe, but that is not to limit the scope of the present invention. A multi-stage rotary compressor having three, four or more rotary compression elements can be also used.

In summary, according to the embodiments described above, in one embodiment of the present invention, the refrigerant cycling device, in which a compressor, a gas cooler, a throttling means and an evaporator are connected in serial in which a hyper critical pressure is generated at a high pressure side. The compressor comprises an electric motor element, a first and a second rotary compression elements in a sealed container wherein the first and the second rotary compression elements are driven by the electric motor element, and wherein a refrigerant compressed and discharged by the first rotary compression element is compressed by absorbing into the second rotary compression element, and is discharged to the gas cooler. The refrigerant cycling device comprises an intermediate cooling loop for radiating heat of the refrigerant discharged from the first rotary compression element by using the gas cooler; a first internal heat exchanger, for exchanging heat between the refrigerant coming out of the gas cooler from the second rotary compression element and the refrigerant coming out of the evaporator; and a second internal heat exchanger, for exchanging heat between the refrigerant coming out of the gas cooler from the intermediate cooling loop and the refrigerant coming out of the first internal heat exchanger from the evaporator. In this way, the refrigerant coming out of the evaporator exchanges heat at the first internal heat exchanger with the refrigerant coming out of the gas cooler from the second rotary compression element to take heat, and exchanges heat at the second internal heat exchanger with the refrigerant that comes out of the gas cooler and flows in the intermediate cooling loop, so as to take heat. Therefore, a superheat degree of the refrigerant can be actually maintained and a liquid compression in the compression can be avoided.

In addition, since the refrigerant coming out of the gas cooler from the second rotary compression element takes heat at the first internal heat exchanger from the refrigerant coming out the evaporator, the refrigerant temperature can be reduced. In this way, the cooling ability of the refrigerant gas at the evaporator can be improved and increased. Therefore, a desired evaporation temperature can be easily achieved without increasing the refrigerant cycling amount, and the power consumption of the compressor can be reduced.

Moreover, because of the intermediate cooling loop, the temperature inside the compressor can be reduced. Particularly in that situation, after heat of the refrigerant flowing through the intermediate cooling loop is radiated by the gas cooler, heat is then provided to the refrigerant coming from the evaporator, and the refrigerant is then absorbed into the second rotary compression element. Therefore, a temperature rising inside the compressor, caused by arranging the second internal heat exchanger, will not occur.

Additionally, in the above refrigerant cycling device, since the refrigerant uses carbon dioxide, it can provide a contribution to solve the environment problem.

Furthermore, the aforementioned refrigerant cycling device is very effective for a condition that an evaporation temperature of the refrigerant at the evaporator is from +12° C. to −10° C.

In another embodiment of the present invention, the refrigerant cycling device, in which a compressor, a gas cooler, a throttling means and an evaporator are connected in serial in which a hyper critical pressure is generated at a high pressure side. The compressor comprises an electric motor element, a first and a second rotary compression elements in a sealed container wherein the first and the second rotary compression elements are driven by the electric motor element, and wherein a refrigerant compressed and discharged by the first rotary compression element is compressed by absorbing into the second rotary compression element, and is discharged to the gas cooler. The refrigerant cycling device comprises an intermediate cooling loop for radiating heat of the refrigerant discharged from the first rotary compression element by using the gas cooler; an oil separating means for separating oil from the refrigerant compressed by the second rotary compression element; an oil return loop for depressurizing the oil separated by the oil separating means and then returning the oil back to the compressor; a first internal heat exchanger, for exchanging heat between the refrigerant coming out of the gas cooler from the second rotary compression element and the refrigerant coming out of the evaporator; a second internal heat exchanger for exchanging heat between the oil flowing in the oil return loop and the refrigerant coming out of the first internal heat exchanger form the evaporator; and an injection loop, for injecting a portion of the refrigerant flowing between the first and the second throttling means into an absorption side of the second rotary compression element of the compressor. In this manner, the refrigerant coming out of the evaporator exchanges heat at the first internal heat exchanger with the refrigerant coming out of the gas cooler from the second rotary compression element to take heat, and exchanges heat at the second internal heat exchanger with the oil that flows in the oil return loop, so as to take heat. Therefore, a superheat degree of the refrigerant can be actually maintained and a liquid compression in the compression can be avoided.

In addition, since the refrigerant coming out of the gas cooler from the second rotary compression element takes heat at the first internal heat exchanger from the refrigerant coming out the evaporator, the refrigerant temperature can be reduced. Moreover, because of the intermediate cooling loop, the temperature inside the compressor can be reduced.

In addition, after the oil flowing in the oil return loop takes heat from the refrigerant coming out of the first internal heat exchanger from the evaporator at the second internal heat exchanger, the oil returns back to the compressor. Therefore, the temperature in the compressor can be further reduced.

Furthermore, a portion of the refrigerant flowing between the first and the second throttling means passes through the injection loop, and then is injected to the absorption side of the second rotary compression element of the compressor. Therefore, the second rotary compression element can be cooled by the injected refrigerant. In this way, the compression efficiency of the second rotary compression element can be improved, and additionally, the temperature of the compressor itself can be further reduced. Accordingly, the evaporation temperature of the refrigerant at the evaporator of the refrigerant cycling device can be also reduced.

Namely, by and effect that the intermediate pressure refrigerant gas compressed by the first rotary compression is made to pass through the intermediate cooling loop to suppress the temperature rising in the sealed container, by an effect that the oil separated from the refrigerant gas by the oil separator is made to pass through the second internal heat exchanger to suppress the temperature rising in the sealed container, and further by an effect that a portion of refrigerant flowing between the first throttling means and the second throttling means is injected to the absorption side of the second rotary compression element of the compressor to absorb heat from ambience to evaporate so as to cool the second rotary compression element, the compression efficiency of the second rotary compression element can be improved. In addition, by an effect that the refrigerant gas compressed by the second rotary compression element is made to pass through the first internal heat exchanger to reduce the refrigerant temperature at the evaporator, the cooling ability at the evaporator can be considerably increased and improved, and the power consumption of the compressor can be also reduced.

According to the present invention, because the gas-liquid separating means is arranged between the first throttling means and the second throttling means, and the injection loop depressurizes the liquid refrigerant separated by the gas-liquid separating means to inject the liquid refrigerant to the absorption side of the second rotary compression element of the compressor, the refrigerant from the injection loop evaporates and absorbs heat from ambience, so that the compressor itself, including the second rotary compression element, can be further effectively cooled. In this way, the refrigerant temperature at the evaporator can be further reduced.

In addition, in the oil return loop, after the oil separated by the oil separating means exchanges heat at the second internal heat exchanger with the refrigerant coming out of the first internal heat exchanger from the evaporator, the oil returns back to the sealed container of the compressor. Therefore, the temperature in the sealed container of the compressor can be effectively reduced by the oil.

In addition, after the oil separated by the oil separating means exchanges heat at the second internal heat exchanger with the refrigerant coming out of the first internal heat exchanger from the evaporator, the oil return loop returns the oil back to the absorption side of the second rotary compression element of the compressor. Therefore, while lubricating the second rotary compression element, the compression efficiency is improved and the temperature of the compressor itself is effectively reduced.

Moreover, in the above refrigerant cycling device, since the refrigerant can use a refrigerant selected from any one of carbon dioxide, R23 of HFC refrigerant and nitrous suboxide, a desired cooling ability can be obtained and a contribution to solve the environment problem can be provided.

Furthermore, the aforementioned refrigerant cycling device is very effective for a condition that an evaporation temperature of the refrigerant at the evaporator is equal to or less than −50° C.

According to another embodiment of the present invention, in the refrigerant cycling device, a compressor, a gas cooler, a throttling means and an evaporator are connected in serial in which a hyper critical pressure is generated at a high pressure side. The compressor comprises an electric motor element, a first and a second rotary compression elements in a sealed container wherein the first and the second rotary compression elements are driven by the electric motor element, and wherein a refrigerant compressed and discharged by the first rotary compression element is compressed by absorbing into the second rotary compression element, and is discharged to the gas cooler. The refrigerant cycling device comprises an intermediate cooling loop for radiating heat of the refrigerant discharged from the first rotary compression element by using the gas cooler; a first internal heat exchanger, for exchanging heat between the refrigerant coming out of the gas cooler from the second rotary compression element and the refrigerant coming out of the evaporator; an oil separating means for separating oil from the refrigerant compressed by the second rotary compression element; an oil return loop, for depressurizing the oil separated by the oil separating means and then returning the oil back to the compressor; and a second internal heat exchanger, for exchanging heat between the oil flowing in the oil return loop and the refrigerant coming out of the first internal heat exchanger form the evaporator. In this way, In this manner, the refrigerant coming out of the evaporator exchanges heat at the first internal heat exchanger with the refrigerant coming out of the gas cooler from the second rotary compression element to take heat, and exchanges heat at the second internal heat exchanger with the oil that flows in the oil return loop, so as to take heat. Therefore, a superheat degree of the refrigerant can be actually maintained and a liquid compression in the compression can be avoided.

In addition, since the refrigerant coming out of the gas cooler from the second rotary compression element takes heat at the first internal heat exchanger from the refrigerant coming out the evaporator, the refrigerant temperature can be reduced. Moreover, because of the intermediate cooling loop, the temperature inside the compressor can be reduced.

Furthermore, after the oil flowing in the oil return loop takes heat from the refrigerant coming out of the first internal heat exchanger from the evaporator at the second internal heat exchanger, the oil returns back to the compressor. Therefore, the temperature in the compressor can be further reduced, so that the evaporation temperature of the refrigerant at the evaporator of the refrigerant cycling device can be also reduced.

Namely, by and effect that the intermediate pressure refrigerant gas compressed by the first rotary compression is made to pass through the intermediate cooling loop to suppress the temperature rising in the sealed container, and by an effect that the oil separated from the refrigerant gas by the oil separating means is made to pass through the second internal heat exchanger to suppress the temperature rising in the sealed container, the compression efficiency of the second rotary compression element can be improved. In addition, by an effect that the refrigerant gas compressed by the second rotary compression element is made to pass through the first internal heat exchanger to reduce the refrigerant temperature at the evaporator, the cooling ability at the evaporator can be considerably increased and improved, and the power consumption of the compressor can be also reduced.

In the above refrigerant cycling device, after the oil separated by the oil separating means exchanges heat at the second internal heat exchanger with the refrigerant coming out of the first internal heat exchanger from the evaporator, the oil return loop returns the oil back to the sealed container of the compressor. Therefore, the temperature in the compressor can be effectively reduced by the oil, and the temperature rising in the sealed container can be suppressed.

In the above refrigerant cycling device, after the oil separated by the oil separating means exchanges heat at the second internal heat exchanger with the refrigerant coming out of the first internal heat exchanger from the evaporator, the oil return loop returns the oil back to the absorption side of the second rotary compression element of the compressor. Therefore, the compression efficiency of the second rotary compression element is improved and the interior of the compressor can be cooled.

Additionally, in the above refrigerant cycling device, since the refrigerant uses carbon dioxide, it can provide a contribution to solve the environment problem.

Furthermore, the aforementioned refrigerant cycling device is very effective for a condition that an evaporation temperature of the refrigerant at the evaporator is from −30° C. to −10° C.

According to another embodiment of the present invention, in the refrigerant cycling device, a compressor, a gas cooler, a throttling means and an evaporator are connected in serial in which a hyper critical pressure is generated at a high pressure side. The compressor comprises an electric motor element, a first and a second rotary compression elements in a sealed container wherein the first and the second rotary compression elements are driven by the electric motor element, and wherein a refrigerant compressed and discharged by the first rotary compression element is compressed by absorbing into the second rotary compression element, and is discharged to the gas cooler. The refrigerant cycling device comprises a bypass loop, for supplying the refrigerant discharged from the first compression element to the evaporator without depressurizing the refrigerant; and a valve means for opening the bypass loop when the evaporator is defrosting, wherein the valve means also opens the bypass loop when the compressor starts. When the evaporator is in defrosting, the valve device is open. Therefore, the discharged refrigerant flows from the first compression element to the bypass loop, and then is provided to the evaporator for heating without depressurizing the refrigerant.

In this way, when the high pressure refrigerant discharged from the second compression element is supplied to the evaporator to defrost without depressurizing, a pressure inversion phenomenon between the absorption side and the discharging side of the second compression element can be avoided during the defrosting operation.

In addition, when the compressor starts, the valve device is also open. By passing the bypass loop, since the pressure at the discharging side of the first compression element (i.e., the absorption side of the second compression element) can be released to the evaporator, an pressure inversion phenomenon between the absorption side of the second compression element (the intermediate pressure) and the discharging side of the second compression element (the high pressure) when the compressor starts can be avoided.

In this way, since the compressor can avoid a unstable operation behavior, the performance and the durability of the compressor can be improved. Therefore, a stable operation condition of the refrigerant cycling device can be maintained, and the reliability of the refrigerant cycling loop can be improved.

In particular, since the refrigerant discharged form the first compression element can escape to the exterior of the compressor by using the bypass loop that is used in defrosting, a pressure inversion phenomenon between the absorption side and the discharging side of the second compression element can be avoided without changing the pipe arrangement. Therefore, the manufacturing cost can be reduced.

According to another embodiment of the present invention, in the refrigerant cycling device, a compressor, a gas cooler, a throttling means and an evaporator are connected in serial, and the compressor comprises a first and a second rotary compression elements, and wherein a refrigerant compressed and discharged by the first rotary compression element is compressed by being absorbed into the second rotary compression element and then is discharged to the gas cooler. The refrigerant cycling device comprises a refrigerant pipe for absorbing the refrigerant compressed by the first rotary compression element into the second rotary compression element; an intermediate cooling loop is connected to the refrigerant pipe in parallel; and a valve device for controlling the refrigerant discharged by the first rotary compression element to flow to the refrigerant pipe or to the intermediate cooling loop. In this way, whether the refrigerant flows to the intermediate cooling loop can be selected according to the refrigerant status.

In this way, when flowing to the intermediate cooling loop, a disadvantage that the temperature in the compressor increases abnormally can be avoided. When flowing to the refrigerant pipe, the refrigerant discharging temperature can be increased early when the compressor starts. The refrigerant immersing to the compressor can also return to its normal status early. Therefore, the start ability of the compressor can be improved.

The above refrigerant cycling device further comprises a temperature detecting means arranged at a position capable of detecting a temperature of the refrigerant discharged from the second rotary compression element. When the temperature of the refrigerant discharged from the second rotary compression element, which is detected by the temperature detecting means, increases up to a predetermined value, if the valve device makes the refrigerant to flow to the intermediate cooling loop, a disadvantage that the temperature in the compressor increases abnormally can be avoided.

Alternatively, when the temperature of the refrigerant discharged from the second rotary compression element, which is detected by the temperature detecting means, is lower than the predetermined value, the refrigerant flows to the refrigerant pipe, the temperature of the discharged refrigerant from the second rotary compression element can be easily increased when the compressor starts. In this way, since the refrigerant temperature can be easily increased when starting the compressor, the refrigerant immersing to the compressor can return to its normal status quickly. Therefore, the start ability of the compressor can be further improved.

In another embodiment of the present invention, the compressor has a first and a second rotary compression element driven by a rotational shaft of a driving electric motor element in a sealed container. The compressor comprises cylinders for respectively constructing the first and the second rotary compression elements; rollers respectively formed in the cylinders, wherein each of the rollers is embedded to an eccentric part of the rotational shaft to rotate eccentrically; an intermediate partition plate interposing among the rollers and the cylinders to partition the first and the second rotary compression elements; a supporting member for blocking respective openings of the cylinders and having a bearing of the rotational shaft; and an oil hole formed in the rotational shaft, wherein a penetration hole for connecting the sealed container and an inner side of the rollers is formed in the intermediate partition plate, and a connection hole for connecting the penetration hole of the intermediate partition hole and an absorption side of the second rotary compression element is pierced in the cylinders that constructs the second rotary compression element. Therefore, by using the intermediate partition plate, the high pressure refrigerant accumulated at the inner side of the roller can be released to the inside of the sealed container.

In this way, the oil can be supplied from the oil supplying hole of the rotational shaft by using the pressure difference in the inner side of the roller. Therefore, an insufficient oil amount at the peripheral of the eccentric part of the inner side of the roller can be avoided.

In addition, even though the pressure in the cylinder of the second rotary compression element is higher than the pressure in the sealed container (the intermediate pressure), by using an absorption pressure loss in the absorption process of the second rotary compression element, the oil can be actually supplied to the absorption side of the second rotary compression element from the penetration hole formed in the intermediate partition plate.

by the above structure, the performance of the compressor can be maintained and the reliability of the compressor can be improved. In particular, by the simple structure where the penetration hole connecting the sealed container and the inner side of the roller is pierced and the connection hole connecting the absorption side of the second rotary compression element and the penetration hole of the intermediate partition plate is pierced in the cylinder that constructs the second rotary compression element, the high pressure at the inner side of the roller can be released and the oil can be supplied to the second rotary compression element. Therefore, the structure is simplified and the cost is reduced.

In the above compressor, the driving element can be a motor of a rotational number controllable type, which starts with a low speed. Therefore, when the compressor starts, even though the second rotary compression element absorbs the oil in the sealed container from the penetration hole of the intermediate partition plate connecting to the sealed container, an adverse influence due to the oil compression can be suppressed. Accordingly, a reduction of the reliability of the compressor can be reduced.

According to another embodiment, an oil accumulator for separating oil discharged from the rotary compression together with the refrigerant and then for accumulating the oil is formed in the rotary compression element; and a return passage having a throttling function, wherein the oil accumulator is connected to the sealed container through the return passage. Therefore, an oil amount discharged from the rotary compression element to the exterior of the compressor can be reduced.

In this way, the present invention can avoid extremely a disadvantage that a large amount of oil flows into the refrigerant cycling loop to degrade the function of the refrigerant cycle.

In addition, since the oil accumulated in the oil accumulator returns back to the sealed container through the return passage with a throttling function, a disadvantage that the sealed container has insufficient oil amount can be avoided.

As described above, the oil discharging to the refrigerant cycling loop can be extremely reduced, and the oil in the sealed container can be smoothly supplied. Therefore, the ability and the reliability of the rotary compressor can be improved.

In the internal intermediate pressure multi-stage compression type rotary compressor comprises, an oil accumulator for separating oil discharged from the second rotary compression together with the refrigerant and then for accumulating the oil is formed in the rotary compression mechanism; and a return passage having a throttling function, wherein the oil accumulator is connected to the sealed container through the return passage. Accordingly, an oil amount discharged from the second rotary compression element to the exterior of the compressor can be reduced.

In this way, the present invention can avoid extremely a disadvantage that a large amount of oil flows into the refrigerant cycling loop to degrade the function of the refrigerant cycle.

In addition, since the oil accumulated in the oil accumulator returns back to the sealed container through the return passage with a throttling function, a disadvantage that the sealed container has insufficient oil amount can be avoided.

As described above, the oil discharging to the refrigerant cycling loop can be extremely reduced, and the oil in the sealed container can be smoothly supplied. Therefore, the ability and the reliability of the rotary compressor can be improved.

In the above compressor, it further comprises a second cylinder constructing the second rotary compression element; a first cylinder arranged under the second cylinder through a intermediate partition plate and constructing the first rotary compression element; a first supporting member for blocking a lower part of the first cylinder; a second supporting member for blocking an upper part of the second cylinder; and an absorption passage formed in the first rotary compression element. The oil accumulator is formed in the first cylinder other than a portion where the absorption passage is formed. Therefore, the space efficiency can be improved and increased.

In the previous structure, the oil accumulator is formed by a penetration hole that vertically penetrates through the second cylinder, the intermediate partition plate and the first cylinder. Therefore, the processing workability for forming the oil accumulator can be obviously improved.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A refrigerant cycling device, wherein a compressor, a gas cooler; a throttling means and an evaporator are connected in serial in which a hyper critical pressure is generated at a high pressure side, and the compressor comprises an electric motor element, a first and a second rotary compression elements in a sealed container wherein the first and the second rotary compression elements are driven by the electric motor element, and wherein a refrigerant compressed and discharged by the first rotary compression element is compressed by absorbing into the second rotary compression element, and is discharged to the gas cooler, the refrigerant cycling device comprising:

an intermediate cooling loop for radiating heat of the refrigerant discharged from the first rotary compression element by using the gas cooler;

an oil separating means for separating oil from the refrigerant compressed by the second rotary compression element;

an oil return loop for depressurizing the oil separated by the oil separating means and then returning the oil back to the compressor;

a first internal heat exchanger, for exchanging heat between the refrigerant coming out of the gas cooler from the second rotary compression element and the refrigerant coming out of the evaporator;

a second internal heat exchanger for exchanging heat between the oil flowing in the oil return loop and the refrigerant coming out of the first internal heat exchanger form the evaporator; and an injection loop, for injecting a portion at the refrigerant flowing between the first and the second throttling means into an absorption side of the second rotary compression element of the compressor.

2. The refrigerant cycling device of claim 1, further comprising a gas-liquid separating means disposed between the first throttling means and the second throttling means, wherein the injection loop depressurizes a liquid refrigerant separated by the gas-liquid separating means, and then injects the liquid refrigerant into the absorption side of the second rotary compression element of the compressor.

3. The refrigerant cycling device of claim 1, wherein after the oil separated by the oil separating means exchanges heat at the second internal heat exchanger with the refrigerant coming out of the first internal heat exchanger from the evaporator, the oil return loop returns the oil back to the sealed container of the compressor.

4. The refrigerant cycling device of claim 1, wherein the refrigerant uses a refrigerant selected from any one of carbon dioxide, R23 of HFC refrigerant and nitrous suboxide.

5. The refrigerant cycleing device of claim 1, wherein an evaporation temperature of the refrigerant at the evaporator is equal to or less than −50° C.

* * * * *